US005761561A

United States Patent [19]

Foster et al.

[11] Patent Number: 5,761,561

[45] Date of Patent: Jun. 2, 1998

[54] PHOTOGRAPHIC PROCESSOR AND METHOD OF OPERATION

[75] Inventors: David George Foster, West Henrietta; Edgar Preston Gates, Honeoye; John Howard Rosenburgh, Hilton, all of N.Y.

[73] Assignee: Eastman Kodak Company, Rochester, N.Y.

[21] Appl. No.: 720,403

[22] Filed: Sep. 30, 1996

[51] Int. Cl.[6] ..... G03D 3/02; G03D 13/04

[52] U.S. Cl. ..... 396/578; 396/626; 396/636

[58] Field of Search ..... 396/568, 569, 396/570, 578, 626, 630, 636, 564, 589, 598

[56] References Cited

U.S. PATENT DOCUMENTS

| | | | |
|---|---|---|---|
| 3,699,869 | 10/1972 | Jensen | 396/626 |
| 4,168,117 | 9/1979 | Work | 396/630 |
| 4,190,346 | 2/1980 | Hutson et al. | 396/630 |
| 4,402,590 | 9/1983 | Rubin | 396/636 |
| 4,577,951 | 3/1986 | Takahashi et al. | 396/636 |
| 4,708,453 | 11/1987 | Fryda et al. | 396/636 |
| 4,814,809 | 3/1989 | De Prijcker et al. | 396/626 |
| 4,872,033 | 10/1989 | Watanabe et al. | 396/622 |
| 4,907,023 | 3/1990 | Koboshi et al. | 396/626 |
| 4,922,276 | 5/1990 | Lamprecht et al. | 396/577 |
| 4,994,837 | 2/1991 | Samuels et al. | 396/578 |
| 5,001,506 | 3/1991 | Nakamura | 396/630 |
| 5,031,797 | 7/1991 | Boris et al. | 222/23 |
| 5,179,404 | 1/1993 | Bartell et al. | 396/641 |
| 5,258,796 | 11/1993 | Patterson | 396/626 |
| 5,335,190 | 8/1994 | Nagle et al. | 364/571.01 |
| 5,347,337 | 9/1994 | Patton et al. | 396/626 |
| 5,361,114 | 11/1994 | Earle | 396/617 |
| 5,379,087 | 1/1995 | Devaney et al. | 396/636 |
| 5,386,261 | 1/1995 | Patton et al. | 396/626 |
| 5,396,316 | 3/1995 | Smith | 399/120 |
| 5,400,106 | 3/1995 | Rosenburgh et al. | 396/626 |
| 5,420,658 | 5/1995 | Manico et al. | 396/619 |
| 5,477,300 | 12/1995 | Fujimoto et al. | 396/572 |
| 5,488,447 | 1/1996 | Patton et al. | 396/578 |

FOREIGN PATENT DOCUMENTS 0 675 072 10/1995 European Pat. Off. .

*Primary Examiner*—D. Rutledge
*Attorney, Agent, or Firm*—Frank Pincelli; David A. Novais

[57] ABSTRACT

A modular photographic processor for processing a photosensitive material. The processor comprising a modular processing section containing at least one removable processing tank for holding a processing solution therein. The one removable processing tank having an outlet port and an inlet port. The processor also includes a modular recirculation system having a first inlet end and a second outlet end. The second outlet end being connected to the inlet port by a first quick disconnect dripless fluid valve assembly and the first inlet end being connected to the outlet port by a second quick disconnect dripless fluid valve assembly. Various fluid processing components may be connected to the apparatus by at least one quick disconnect dripless fluid valve assembly for quick and easy repair or replacement of that component. The modular processor allows the quick and easy customizing or conversion of the processor to any desired processing chemistry

27 Claims, 22 Drawing Sheets

FIG. 13
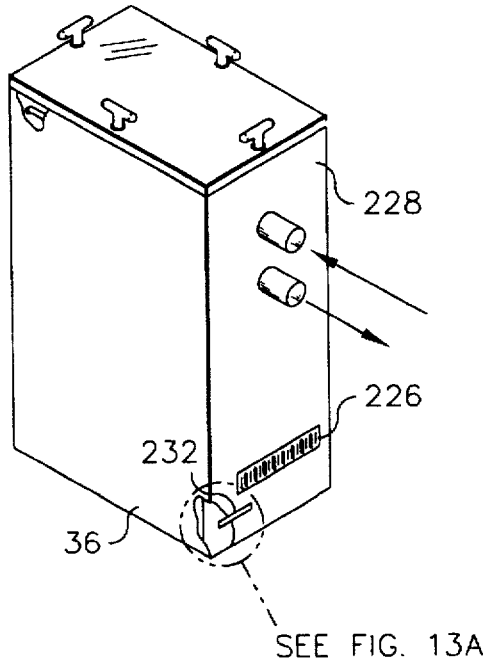
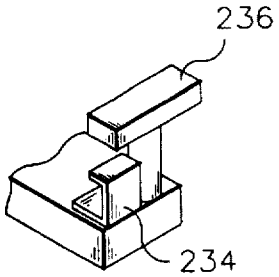
FIG. 13A
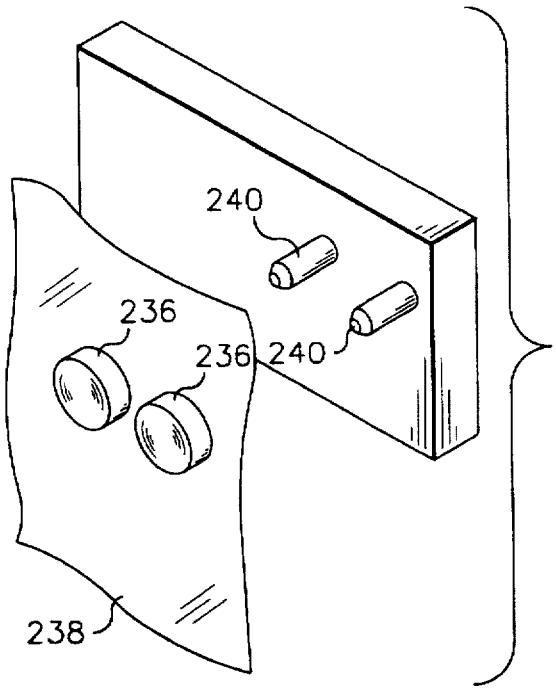
FIG. 14

PHOTOGRAPHIC PROCESSOR AND METHOD OF OPERATION

FIELD OF THE INVENTION

The present invention relates to a photographic processor and method of operation.

REFERENCE TO RELATED APPLICATIONS

This application is related to the following applications filed concurrently herewith:

U.S. Ser. No. 08/724,096, filed Sep. 30, 1996 of David G. Foster, Edgar P. Gates, and John H. Rosenburgh;

U.S. Ser. No. 08/720,400, filed Sep. 30, 1996 of David G. Foster, Edgar P. Gates, and John H. Rosenburgh;

U.S. Ser. No. 08/720,401, filed Sep. 30, 1996 of Edgar P. Gates, and John H. Rosenburgh, and David G. Foster;

U.S. Ser. No. 08/724,717, filed Sep. 30, 1996 of Edgar P. Gates, and John H. Rosenburgh, and David G. Foster;

U.S. Ser. No. 08/723,336, filed Sep. 30, 1996 of Edgar P. Gates, and John H. Rosenburgh, and David G. Foster;

U.S. Ser. No. 08/723,798, filed Sep. 30, 1996 of John H. Rosenburgh, David G. Foster, and Edgar P. Gates; and U.S. Ser. No. 08/723,337, filed Sep. 30, 1996 of John H. Rosenburgh, David G. Foster, and Edgar P. Gates.

BACKGROUND OF THE INVENTION

The processing of photographic sensitive material involves subjecting the photosensitive material to a series of processing steps. In a typical photographic processor, a continuous web of photosensitive material, or cut sheet of photosensitive material, is sequentially passed through a series of processing stations. Each station having a processing tank containing a different photographic processing solution appropriate for the processing step at that station.

Photographic processing apparatus come in a variety of different sizes. A large photographic apparatus utilizes tanks containing approximately 100 liters of processing solution, whereas a small microlab may utilize tanks that contain less than 10 liters of processing solution. In addition, there exist numerous different types of processing chemicals for processing different types of photosensitive material. For example, photographic film generally requires one type of processing chemicals and photographic paper requires a different type. Black and white film, for example, used in graphic art applications requires yet a different type processing chemical. There are also various types of processing chemicals for specific type materials. For example, color film may utilize C41, C41RA, E6, or Kodachrome processing chemicals. In addition to requiring different type processing chemicals, the time that the photosensitive material is required to spend in each processing tank may vary. Generally, a photographic processor is designed for one type processing chemical, or one type photosensitive material. If it can be converted to handle another processing chemical, this requires significant changes and modifications to the overall operation of the apparatus. In addition, the old processing chemicals must be flushed out so as to avoid contamination of the new processing chemicals. Thus, if a photofinisher wishes to handle various photosensitive materials that require various types of processing chemicals, it is necessary to purchase several different types of processing equipment, one for each type of processing chemical or process. This is expensive for the photofinisher.

Another problem experienced by the photofinisher is that if an apparatus is not used frequently, the processing chemicals deteriorate and need to be replaced which adds additional expense and time.

Thus, there exists a need in the prior art to provide a universal type processor that can handle a variety of different type processing chemicals and can be easily converted from one type of processing chemical or process to a different type.

SUMMARY OF THE INVENTION

In one aspect of the present invention there is provided a modular photographic processor for processing a photosensitive material. The processor comprising a modular processing section containing at least one removable processing tank for holding a processing solution therein, the at least one removable processing tank having an outlet port and an inlet port, and a modular recirculation system having a first inlet end and a second outlet end, the second outlet end being connected to the inlet port by a first quick disconnect dripless fluid valve assembly and the first inlet end being connected to the outlet port by a second quick disconnect dripless fluid valve assembly.

In another aspect of the present invention there is provided a modular photographic processor for processing a photosensitive material. The processor comprising a modular processing section containing at least one removable processing tank for holding a processing solution therein, the at least removable processing tank having an outlet port and an inlet port, and a modular recirculation system having a first inlet end and a second outlet end. The second outlet end being connected to the inlet port by a first quick disconnect dripless fluid valve assembly and the first inlet end being connected to the outlet port by a second quick disconnect dripless fluid valve assembly, the recirculation system including at least one fluid processing component which is connected to the recirculation system by at least one quick disconnect dripless fluid valve assembly.

In yet another aspect of the present invention there is provided a modular photographic processor for processing a photosensitive material. The processor comprising a support frame having a plurality of vertically aligned mounting position, and a plurality of removable modular processing sections placed in the plurality of vertically aligned positions.

In another aspect of the present invention there is provided a method of converting a processor designed to process a first type of photosensitive material requiring a first type of processing chemicals to a second type photosensitive material requiring a second different type processing chemicals. The processor comprises a first removable processing tank for holding a processing solution therein at a predetermined location, the first removable processing tank having an outlet port and an inlet port, and a modular recirculation system having a first inlet end and a second outlet end, the second outlet end being connected to the inlet port by a first quick disconnect dripless fluid valve assembly and the first inlet end being connected to the outlet port by a second quick disconnect dripless fluid valve assembly, the recirculation system including at least one fluid processing component which is connected to the recirculation system by at least one quick disconnect dripless fluid valve assembly. The method comprising the steps of:

a) removing the first removable processing tank; and b) providing a second removable processing tank containing a second type processing chemicals and placing the second removable processing tank at the predetermined location.

In still another aspect of the present invention there is provided a method of converting a processor designed to process a first type of photosensitive material requiring a first type of processing chemicals to a second type photosensitive material requiring a second different type processing chemicals. The processor comprising a processing tank for holding a processing solution therein, the processing tank having an outlet port and an inlet port, and a modular recirculation system having a first inlet end and a second outlet end, the second outlet end being connected to the inlet port by a first quick disconnect dripless fluid valve assembly and the first inlet end being connected to the outlet port by a second quick disconnect dripless fluid valve assembly.

The recirculation system including at least one fluid processing component which is connected to the recirculation system by at least one quick disconnect dripless fluid valve assembly. The method comprising the steps of:

a) removing one of the at least one fluid processing components and replacing it with a second fluid component; and b) flushing the system and forwarding any residual therefrom to drain; and c) providing fresh processing chemicals into the second tank.

In another aspect of the present invention there is provided method of evaluating various different set-ups in a processor designed to process photosensitive material. The processor having a modular replaceable processing tank for holding a processing solution therein, the processing replaceable modular tank having an outlet port and an inlet port, and a modular recirculation system having a first inlet and and a second outlet end, the second outlet end being connected to the inlet port by a first quick disconnect dripless fluid valve assembly and the first inlet end being connected to the outlet port by a second quick disconnect dripless fluid valve assembly. The recirculation system including at least one fluid processing component which is connected to the recirculation system by at least one quick disconnect dripless fluid valve assembly. The method comprising the steps of:

a) removing one of the at least one fluid processing components and replacing it with a second fluid component; and b) evaluating the processor or the removed processing component.

The present invention provides a processor that can be set-up quickly and easily in a variety of different ways thus allowing a small photofinisher to have the ability to handle many different processing system with relative small cost as compared to buying individual processor for each type processing system. Additionally the present invention allows for the quick and easy repair and/or maintenance of the processor. The processor also allows the easy incorporation of future developments with the need to by an entire new processor. The present invention can used a tool in the research and development of new processors or processing systems by allowing greater efficiency in reconfiguring, investigating and evaluating new and different processing systems.

These and other advantages of the present invention will be more clearly understood and appreciated from a review of the following detailed description of independent claims, and by reference to the accompanying drawings.

DESCRIPTION OF THE DRAWINGS

FIG. 13 is a perspective view of one of the modular processing sections of FIG. 1 and a portion of the mating portion of the apparatus illustrating one means for identifying the type of modular processing section and the type of processing solution contained therein;

FIGS. 14 and 15 are perspective views of alternate means for identifying an attribute of the processing section;

DETAILED DESCRIPTION OF THE INVENTION

Figure 1:
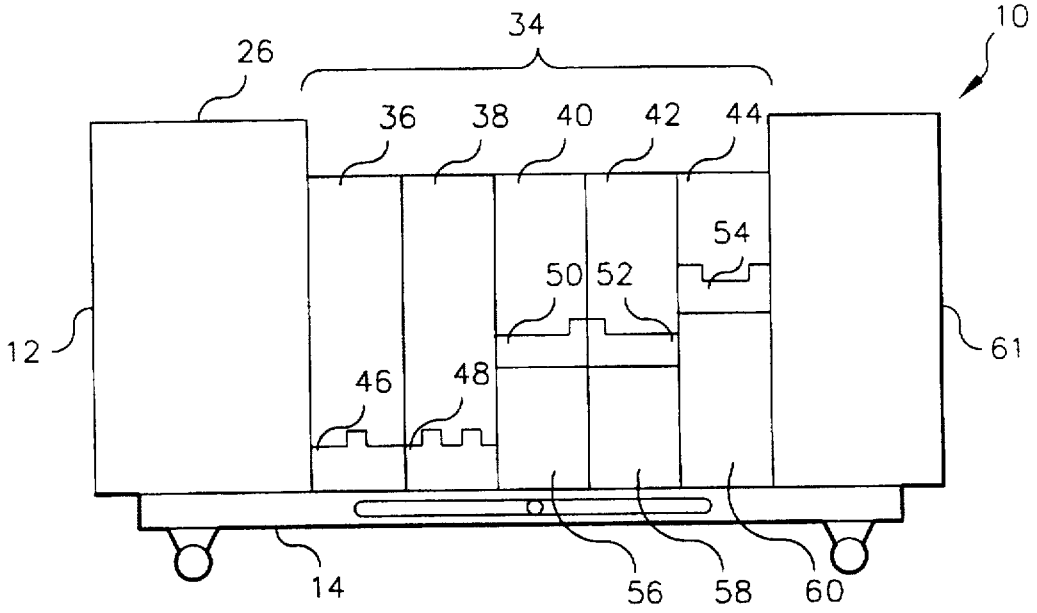
FIG. 1 is an elevational view of a photographic processing apparatus made in accordance with the present invention.
Figure 2:
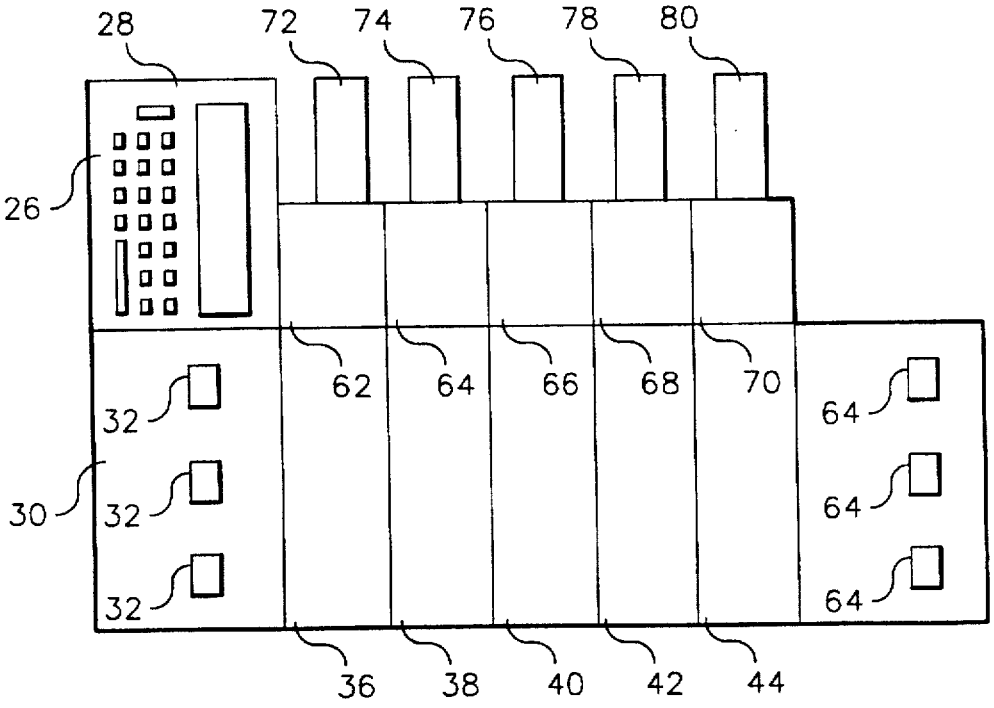
FIG. 2 is a top view of the apparatus of FIG. 1.
Figure 3:
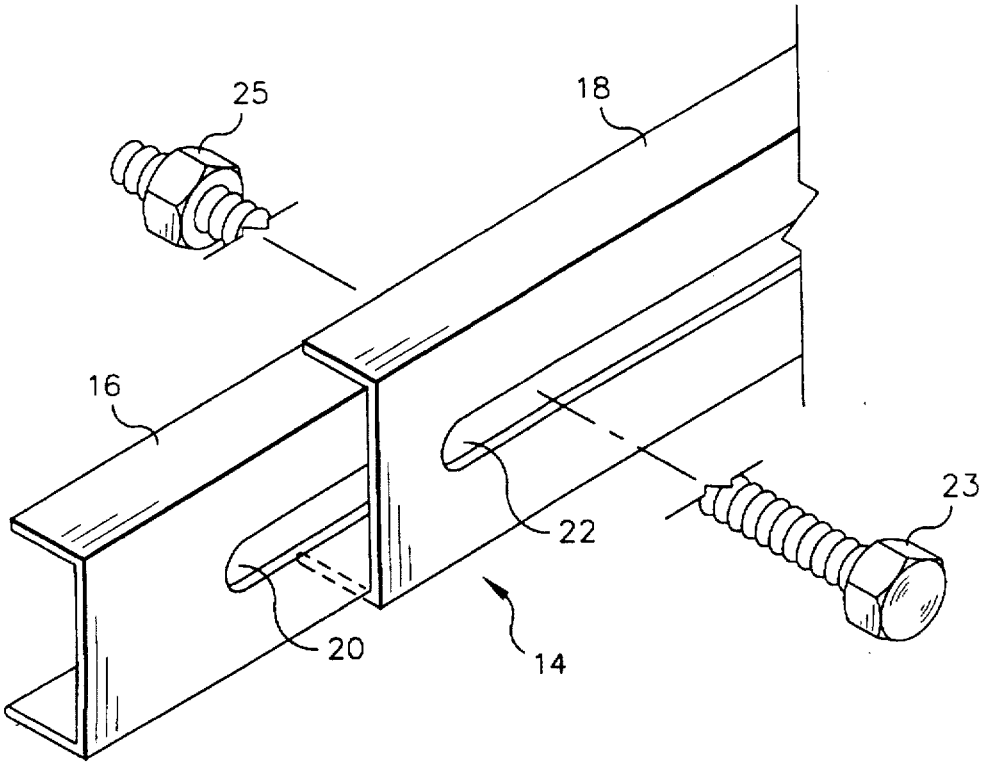
FIG. 3 is a perspective view of a portion of the frame of the apparatus of FIG. 1.
Figure 4:
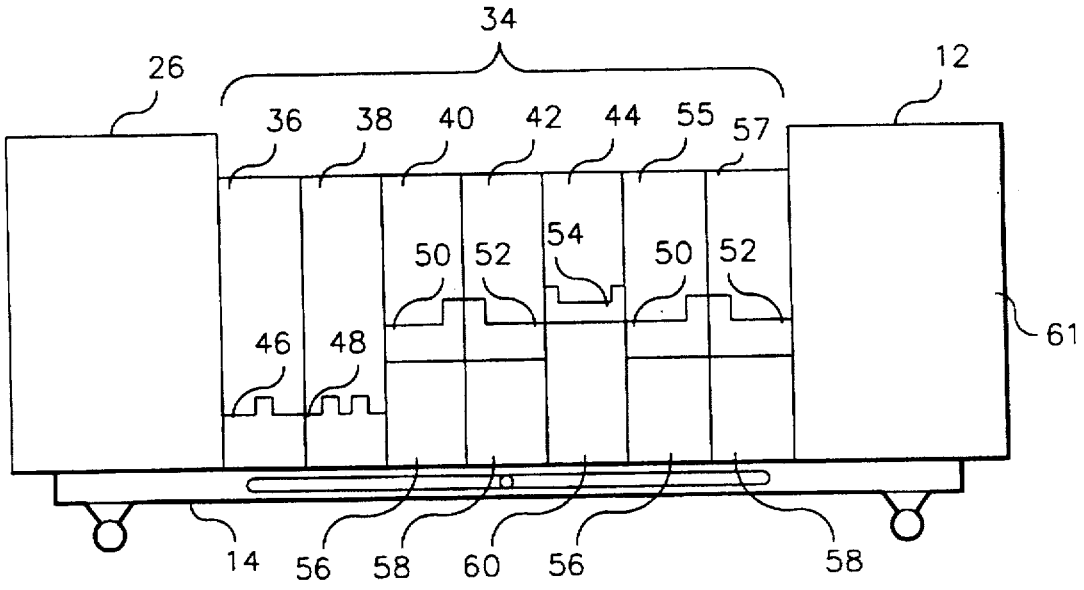
FIG. 4 is an elevational view of a the apparatus of figure configured to include two additional processing stations.

Referring to FIGS. 1 and 2, there is illustrated an apparatus 10 for processing a photosensitive material such as film and/or paper. The apparatus includes a housing 12 which is mounted on a frame 14 which supports the housing 12 and various other components of the apparatus 10. The housing 12 provides a light-tight environment for the component contained therein as is well known to those skilled in photoprocessing. In the preferred embodiment illustrated, the frame 14 comprises a pair of channel members 16,18. Channel member 16 has a general C-shaped cross-section and is designed to slide within substantially C-shaped channel member 18, as illustrated in FIG. 3, so as to allow apparatus 10 to be sized to accommodate the desired number of processing tanks. FIG. 4 illustrates in the providing of two additional processing stations containing processing tanks 55,57. The channel members 16,18 (see FIG. 3) are each provided with slots 20,22, respectively, which are aligned such that a fastening means may pass between the slots 20,22 for securing the two members 16,18 together at the desired length. By sliding the channel members 16,18, respectively, the frame may be adjusted to the desired length to accommodate the desired number of processing stations. In the embodiment illustrated, fastening means comprises a threaded bolt 23 that is secured by a mating threaded nut 25.

The apparatus 10 includes a control section 26 which includes a control panel 28 and a loading section 30 for loading of photosensitive material into the apparatus 10. The control panel 28 provides an operator interface for setting and controlling the operation of the apparatus 10. The control panel 28 is connected to a CPU (central processing unit/computer), contained internally of housing 12, which is used to control the apparatus as is customarily done in the art. In the particular embodiment illustrated, the loading section 30 includes three openings 32, each designed to receive a photosensitive material for processing. In the particular embodiment illustrated, openings 32 are each designed to receive photographic film. However, it is to be understood that the loading section 30 may be designed and configured to receive any type of photosensitive material, either in web or cut sheet form.

The apparatus 10 includes a developing section 34 for developing of unprocessed photosensitive material which comprises a plurality of modular processing tanks 36,38,40,42,44. In the particular embodiment illustrated, processing tank 36 is designed to contain a developing processing solution, tank 38 is designed to hold a bleach/fix processing solution, and tanks 40,42,44 are designed to hold wash and/or stabilizer processing solutions. As previously noted, any desired number of tanks may be provided with appropriate processing solutions as required for processing of the photosensitive material. Each of the modular tanks is designed to be slideably mounted to one of the respective mounting bases 46,48,50,52,54. In the particular embodiment illustrated, the bases 46,48 are attached directly to frame 14, whereas bases 50,52,54 are mounted to spacer members 56,58,60, respectively. The base and/or spacer may be mounted to frame 14 in any conventional manner and the bases may be mounted to spacer members in any desired manner. The spacer members 56,58,60 are provided because the tanks 40,42,44 are not as large as required for tanks 36,38. By providing the appropriately sized spacer member, the tank size can be adjusted so as to provide the desired amount of processing solution for the desired time period.

A dryer 61 is provided adjacent tank 44 for drying of the photosensitive material. After the photosensitive material has passed through the dryer 61, it leaves apparatus 10 through one of the exits 67.

Adjacent each of the processing tanks 36,38,40,42,44 there is provided a recirculation section 62,64,66,68,70, respectively. Each of the modular recirculation sections 62,64,66,68,70 recirculate the processing solution through the adjacent modular processing tank. The modular recirculation sections may be mounted directly to the frame 14 or to the adjacent tank by any desired means. The modular recirculation sections are also described in greater detail later herein.

The apparatus 10 further includes a plurality of modular replenishment sections 72,74,76,78,80, one fluidly connected to each of the modular recirculation sections 62,64,66,68,70, respectively. The modular replenishment sections provide replenishment solution to the processing solution in the recirculation system as is described in greater detail later herein. The modular replenishment section is mounted to the frame 14, or adjacent recirculation system, by any desired means. The modular replenishment sections are described in greater detail later herein.

Figure 5:
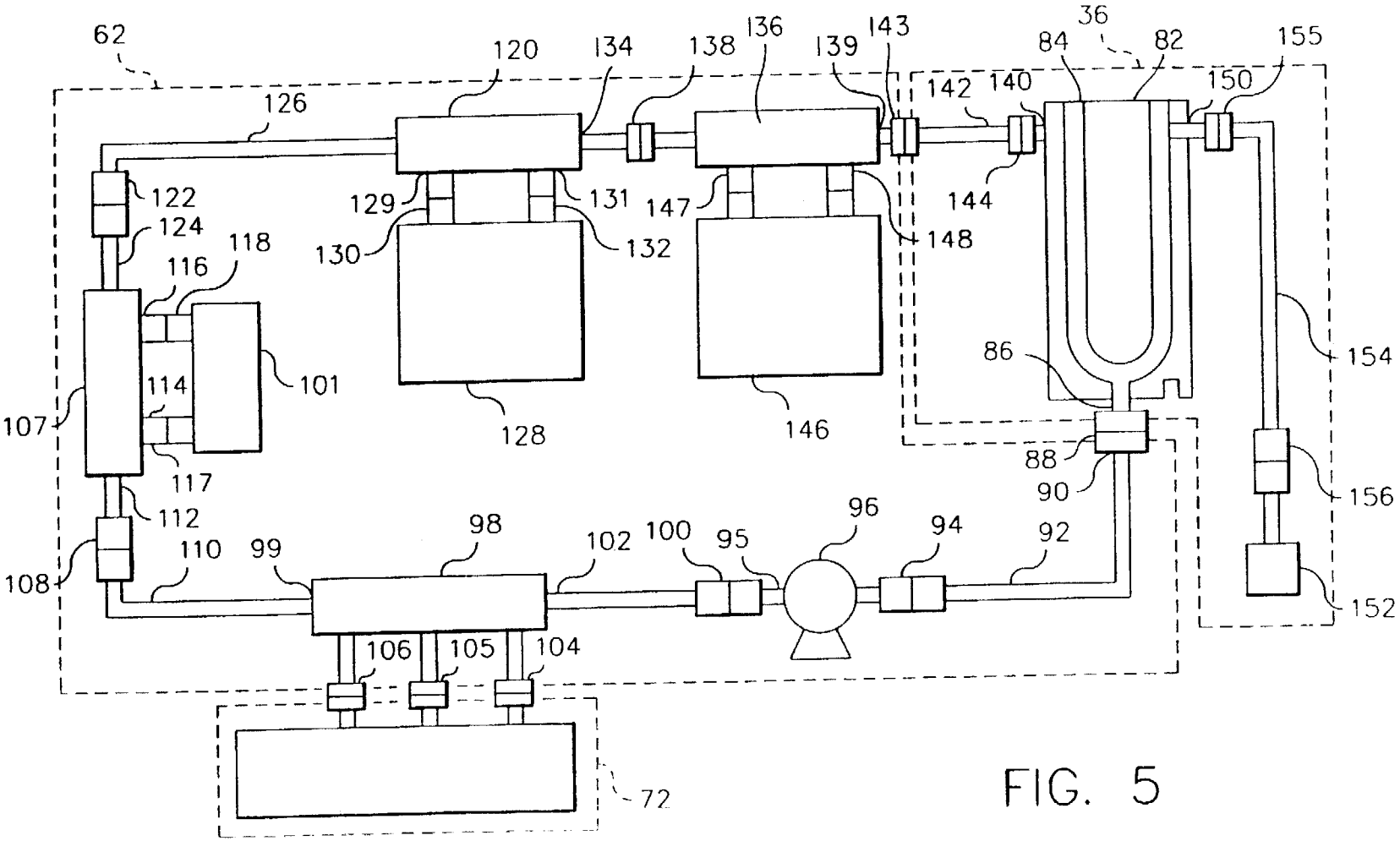
FIG. 5 is a schematic representation of the apparatus of FIG. 1.

Referring to FIG. 5, there is illustrated in schematic form a single processing section/station for one of the developing processing solutions. The station comprises a fluid flow of removable (replaceable) modular processing tank 36, removable (replaceable) modular recirculation section 62, and replaceable modular replenishment section 72. The remaining processing sections for the other processing solutions are similarly constructed and operate in a like manner. Therefore, for the sake of clarity, only one processing section will be described in detail. In the embodiment illustrated, the processing section is of a low volume, thin tank type such as described in U.S. Pat. Nos. 5,179,404 and 5,400,106 which are hereby incorporated by reference. In the particular embodiment illustrated, the processing tank 36 includes a removable rack 82 which forms a narrow processing channel 84 which contains the processing solution through which the photosensitive material is passed for processing. The tank 36 includes an outlet 86 which is connected to inlet 87 of recirculation section 62 by a dripless valve connection (assembly) 88. The inlet 90 is in turn connected to one end of conduit 92. The other end of conduit 92 is connected to a pump 96 through dripless valve connection 94. The pump 96 circulates the processing solution through the processing tank 36. The outlet 95 of pump 94 is fluidly connected to manifold 98 through a quick dripless valve connection 100 and conduit 102. The manifold 98 is fluidly connected to the modular replenishment section 72 by a plurality of dripless valve connections 104,105,106. In the embodiment illustrated, the modular replenishment section 62 comprises a three-part replenishment. It is to be understood that the replenishment section 62 may comprise any number of parts and therefore may require more or less than the three dripless valve connections illustrated. The outlet 99 of manifold 98 is fluidly connected to a manifold 107 by dripless valve connection 108 and conduits 110,112. The manifold 107 is connected to a heater 101 by a pair of quick disconnect dripless valve connections 114,116 through outlet 117 and inlet 118. The fluid outlet 119 of manifold 107 is fluidly connected to a third manifold 120 through another quick disconnect dripless valve connection 122 and conduits 124,126. The manifold 120 allows fluid to pass through filter assembly 128 through an outlet 129 and inlet 131 by a pair of quick disconnect connections 130,132. The outlet 134 of manifold 120 is fluidly connected to a fourth manifold 136 through a quick disconnect connection 138 and the outlet 139 of manifold 136 is fluidly connected to the inlet 140 of tank 36 by conduit 142 and a pair of quick disconnect connections 143,144. An optional treatment cartridge 146 is fluidly attached to manifold 136 by a pair of dripless valve connections 147,148. The tank 36 is provided with an overflow outlet 150 which is connected to an overflow tank 152 by a conduit 154 and pair of quick disconnect connections 155,156. The replenishment section 72 includes a replenishment tank 141 which is fluidly connected to recirculation section 62.

In the preferred embodiment illustrated, conduits 92,102, 110,112,124,126,142 are flexible hoses which assist in the ease of connecting and disconnecting the dripless valve connections.

All of the quick disconnect dripless valve connections/assemblies in the preferred embodiment are substantially the same in construction and operation which allow quick connection and/or disconnection of the adjacent items without any substantial leak or loss of processing solution contained therein. The connections 88,94,100,104,105,106, 108,114,116,122, 130,132,138,143,144,147,148,155,156 in the embodiment illustrated are referred to as "dripless valve connections (or assemblies)". An example of a suitable dripless valve connection is described in EPO Publication 675,072, which is hereby incorporated by reference. For purposes of the present invention, a dripless valve connection shall mean a valve connection wherein little or substantially no fluid leaks occur upon connecting or disconnecting of the associated sections.

For the sake of clarity, only one of the dripless connections will be described in detail, it being understood that the other connections are identical in form and operation. In the particular embodiment illustrated, the dripless connection 88 comprises a male half valve section 160, which mates with a female half valve section 162 so as to provide a fluid connection therebetween. The male or female sections may be placed either on the conduit or on the part being connected as desired.

Figure 6:
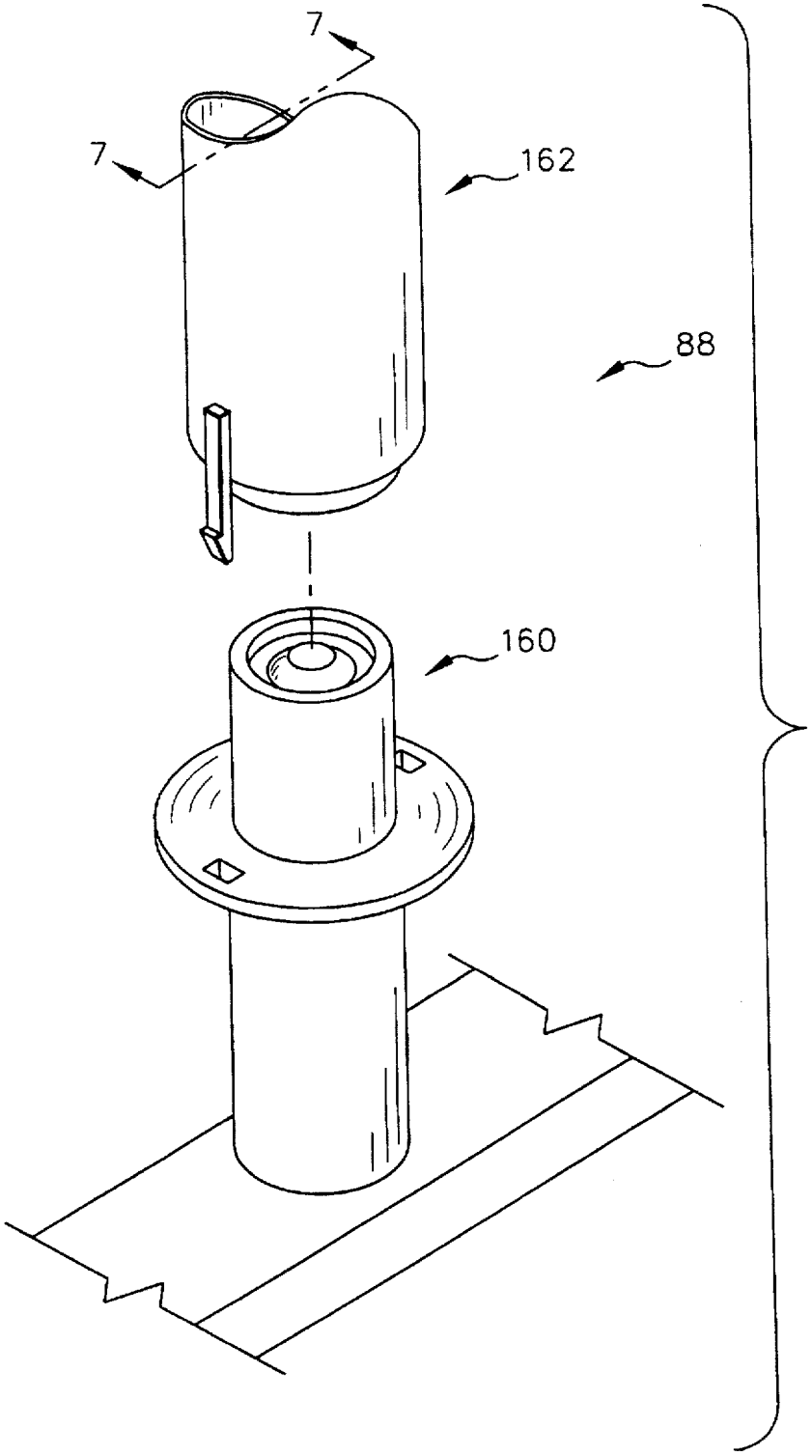
FIG. 6 is an enlarged perspective view of a dripless valve connection used in the apparatus of FIG. 1 shown in the unconnected state.
Figure 7:
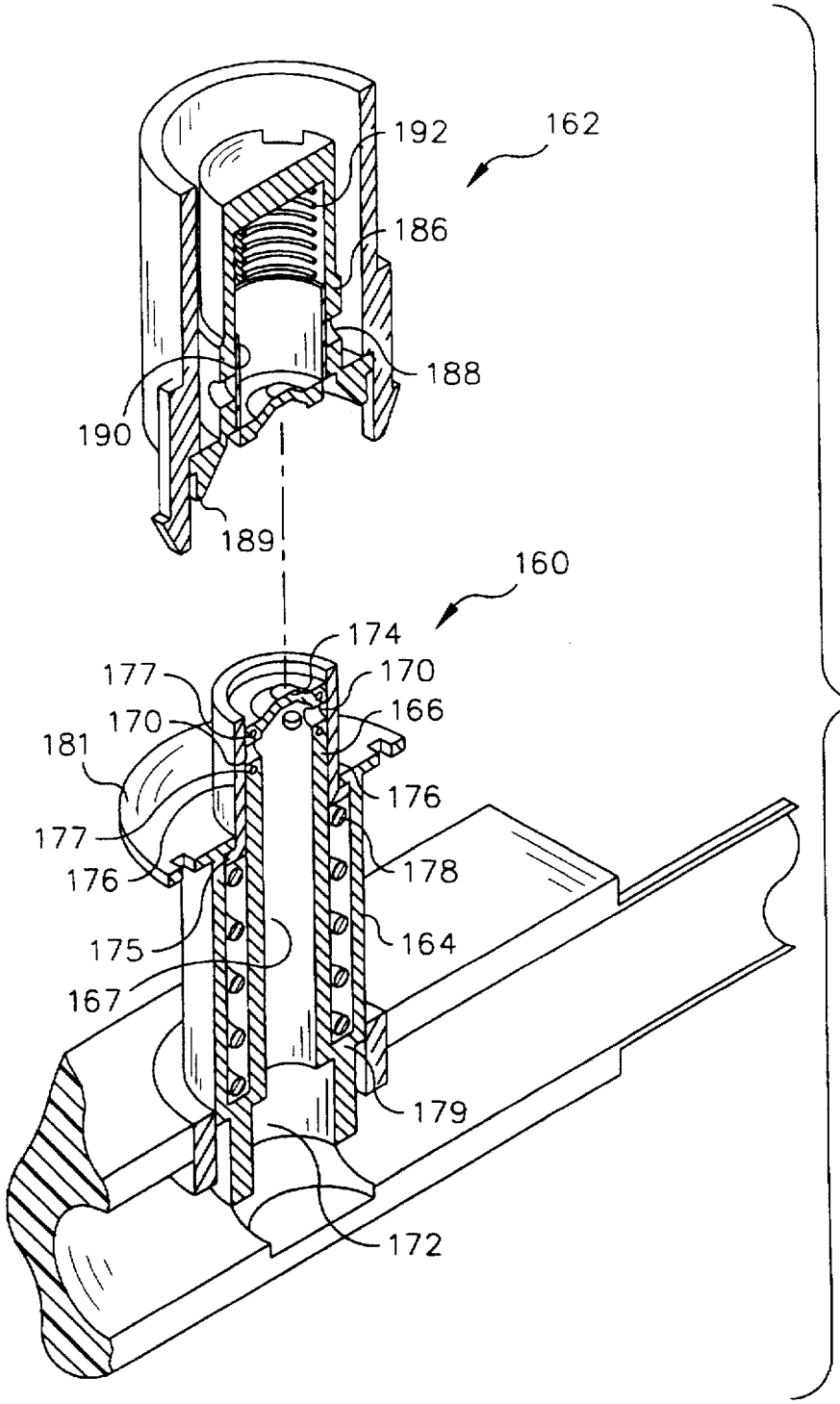
FIG. 7 is a perspective cross-sectional view of the valve connection of FIG. 6 as taken along line 7—7.
Figure 8:
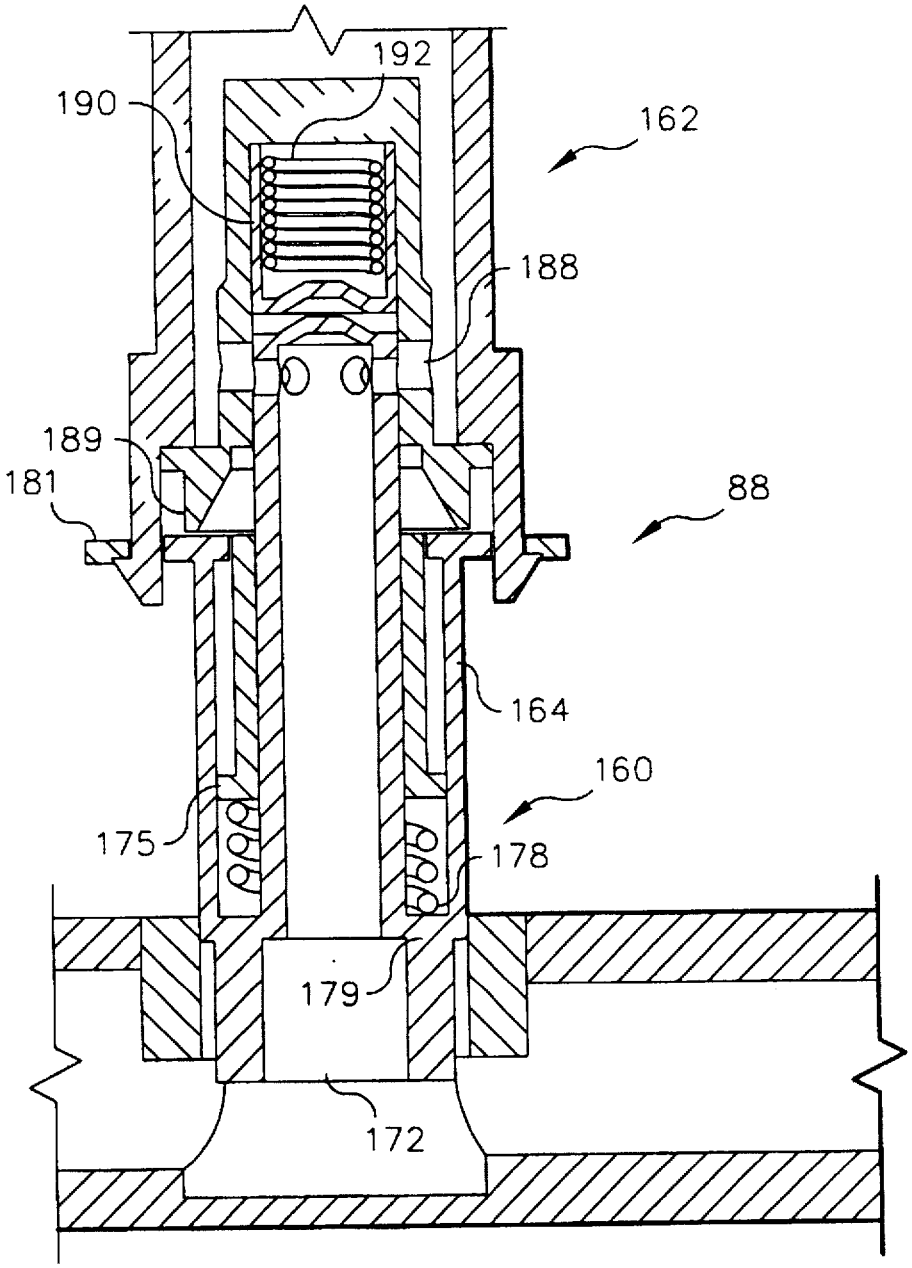
FIG. 8 is a cross sectional view of the valve connection of FIGS. 6 and 7 in the engaged position.

Referring to FIGS. 6, 7, and 8, male half valve section 160 comprises a body member 164, and elongated proboscis member 166 is positioned concentrically with body member 164. Proboscis member 166 comprises a longitudinal channel 167 having a plurality of radial fluid ports 170 which allow fluid to pass therethrough, and a fluid passage 172 to deliver or receive fluid. Ports 170 are positioned at a closed end portion 174 of channel 167. A movable block member 176, preferably a sleeve, is slideably mounted telescopically around proboscis member 166 for selectively opening and closing ports 170. A pair of resilient O-rings 177 provide a seal between member 176 and proboscis member 166 on either side of ports 170.

A spring member 178 is captured between blocking member 176, a shoulder 179, and proboscis member 166 normally biasing block member 176 to the position illustrated in FIG. 6 in which ports 170 are closed or blocked. A radial flange 175 and block member 176 engage member 164 to limit movement of the block member 176. The body member 164 also includes a registration surface 181 upon which a female half valve section 162 engages.

Female mating half valve section 162 comprises a first body member 186; a plurality of entrance ports 188 for allowing fluid to pass therethrough; a hollow piston 190 slideably mounted within the body member 186 from a first position blocking entrance ports 188, shown in FIG. 7, to a second position, as illustrated in FIG. 8, opening entrance ports 188; and a spring member 192 captured between body 186 and piston 190 for normal lead biasing piston 190 to close ports 188. For ease of manufacture, ports 188 may be located as pairs on opposite sides of body 186. A flared tip 189 is provided in first body member 186 which engages registration surface 181 on blocking member 176. When the female half valve section 162 and male valve half section 160 are in the engaged position, see FIG. 8, ports 170,188 are opened, which allows fluid to flow between the sections 160,162 and, when disconnected, fluid does not flow between the sections allowing members to be disengaged. It is, of course, understood that various other dripless valve connections may be used as desired. The benefit in using the dripless valve connections illustrated is that they are easily and quickly disconnected or reconnected, thus allowing the parts to be assembled or disassembled in a quick and efficient manner without any substantial loss of fluid which could be damaging to the apparatus 10, the operator and/or the surrounding environment.

Figure 9:
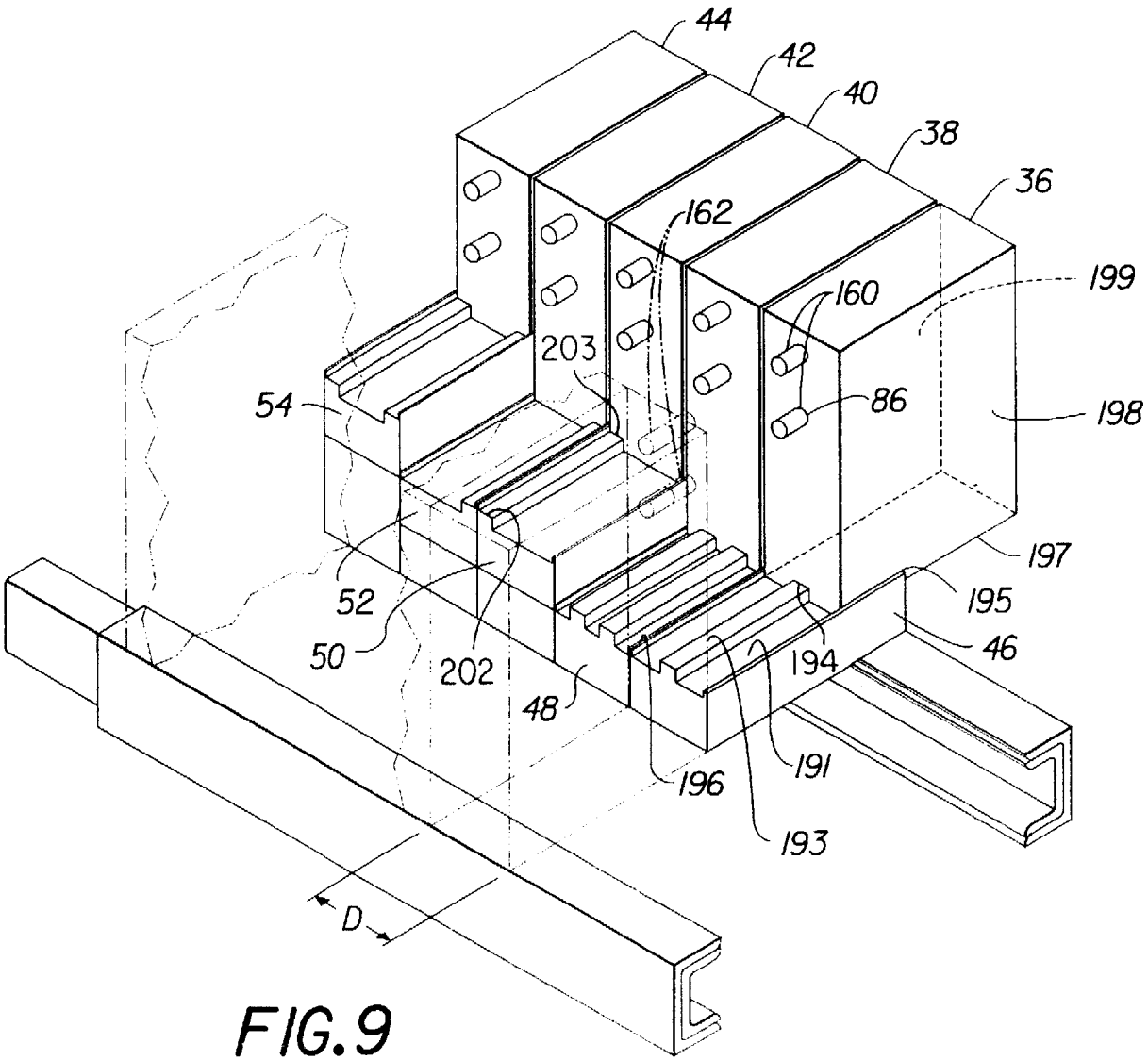
FIG. 9 is a partial perspective view of the apparatus of FIG. 1 illustrating how the modular processing sections are mounted to the frame of the apparatus and the fluid connections between the modular recirculation sections and modular processing sections.

Referring to FIG. 9, there is illustrated a partial perspective view of the apparatus of FIG. 1 illustrating base members 46,48,50,52,54 disposed on frame 14 and how tanks 36,38,40,42,44 are mounted to the bases 46,48,50,52, 54 respectively, and to recirculation modules 62–70, respectively. For the sake of clarity, the connection of tank 36 will be described as it relates only to the base and recirculation section 62, it being understood the remaining tank modules and recirculation modules are likewise constructed. Also, the recirculation section 62 is shown in phantom lines in this figure. In particular, the outlet 86 of tank 36 includes male valve section 160, which is designed to be connected to mating female half valve section 162 on plate 73 of modular recirculation section. Similarly, inlet 140 of tank 36 comprises a male half valve section 160 designed to engage female half valve section 162 on the adjacent modular recirculation section 62. The base 46 has a mounting surface 191 which is provided with an upstanding longitudinal projection 193 which is designed to mate with a correspondingly shaped opening 194 in the lower portion of tank 36. The tank 36 has bottom mounting surface 197 designed to slide on surface 191 such that projection 193 will engage opening 194 between a pair of upstanding side projections 195,196 which are spaced apart a distance D such that they mate with the sides 198,199 of the tank 36 for securely positioning of tank 36 with respect to base 46. The tank 36 simply slides onto the base 46 from one end until the male half valve sections 160 connect with female half valve sections 162 when properly seated in the apparatus 10. As can be seen in the embodiment illustrated, projection 193 is located substantially in the center of the base 46 and is designed only to mate with developer designated tanks which are designed to have the appropriate size projection in the corresponding position. Thus, means are provided to prevent placement of an incorrect type processing tank at a particular location. In the embodiment illustrated the surface 197 of tank 36 slides on surface 191 of the base, if desired roller bearings may be incorporated into the tank and/or base to assist in the mounting of the tank on to its respective base.

Figure 10:
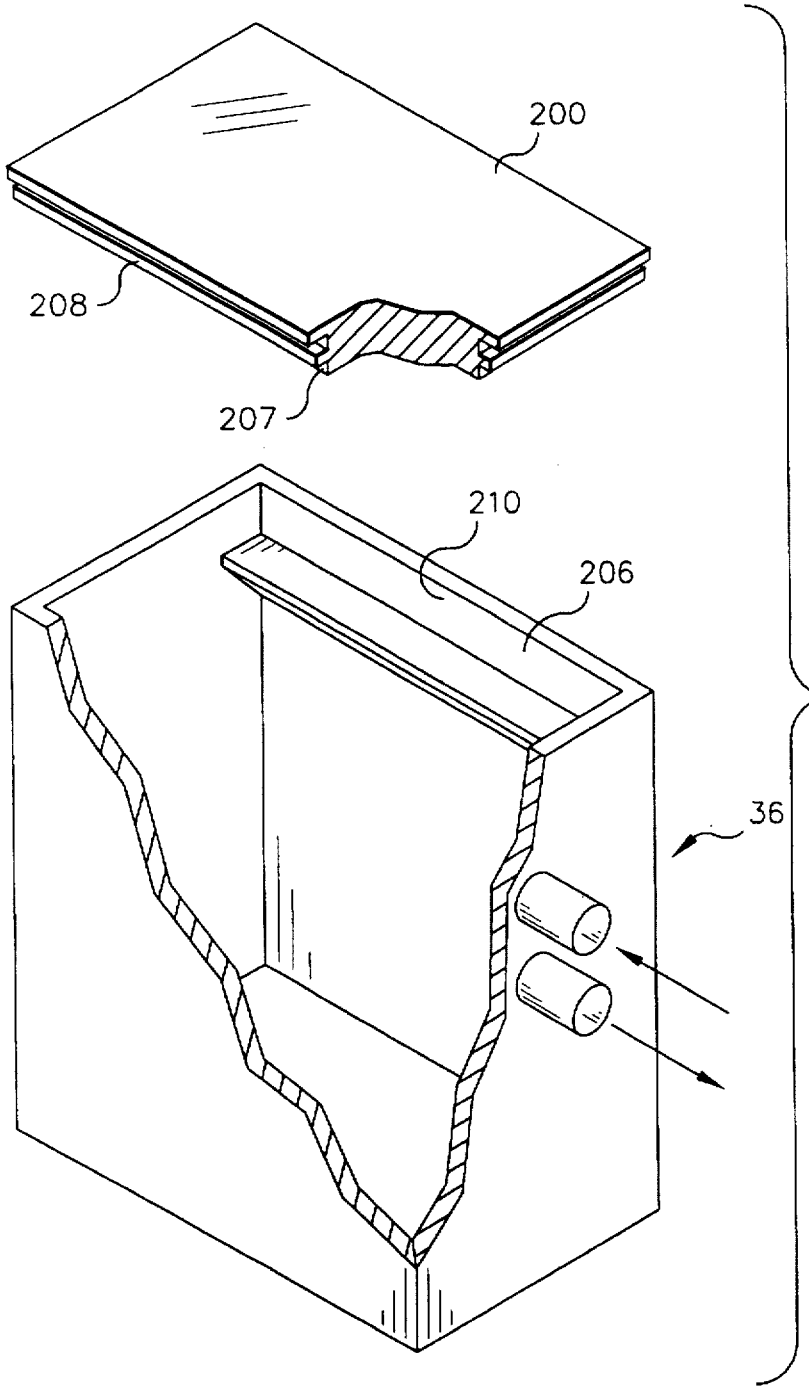
FIG. 10 is a perspective view of one of the modular processing sections of the apparatus of FIG. 1 and its associated lid.

Referring to FIG. 10, the tank 36 is provided with a removable lid 200 which is used to provide a sealing relationship with the access opening 206 of the tank 36 which allows the photosensitive material to enter and exit the processing tank and also allows the placement and/or removal of any equipment therein for moving of the photosensitive material (for example, a processing rack). The lid 200 and dripless valves block all of the fluid entrances and exits of the tank, thus preventing spilling of processing solution that may be contained therein during transportation, storage, insertion, and removal of the tank from the processing apparatus 10. During normal operation of the apparatus 10, the lid 200 is removed, thereby allowing photosensitive material to pass through the tank.

Tank 40, which is designed to be placed in association with base 50, is similar in construction except that tank 40 is smaller in height due to the fact that less time is required in the processing solution for that particular station. To compensate for the height positioning of mating half valves 162, spacer member 56 is provided upon which base 50 is mounted and secured and which is engaged by the tank 40. In this embodiment, the base 50 has a projection 202 on one side which engages a correspondingly shaped recess 203 in the mating tank. The providing of different locations for projection 202 allows the easy discrimination of different type tanks containing different type processing chemicals. As previously discussed, tank 40 is designed to contain a wash and/or stabilization solution. This is in contrast to tank 36, which is designed to contain a developer solution, wherein the recess 194 is designed to mate with projection 193 and is disposed in the central area of the tank. Similarly, different locations can be provided to other types of processing tanks and processing chemicals. After the tanks are properly positioned in the seated position for normal operation, as illustrated in FIGS. 1 and 2, the lid 200 would be removed.

As illustrated by FIG. 10, the lid 200 is designed to provide a sealing relationship with the opening 206 of tank 36. In the particular embodiment illustrated, a sealing rib 208 is provided on the periphery of the internal projecting portion 207 of the lid 200 which extends into and adjacent the inner surface 210 of the tank 36 such that when the lid 200 is placed in the closed position, a liquid-tight seal is provided therebetween. In this embodiment, the lid 200 is held simply by frictional engagement between the lid 200 and the tank 36. However, the lid 204 may be held in a more secured manner so that accidental removal of the lid does not occur. Thus, it is possible to store the tank 36 with the processing solution contained therein. In the embodiment illustrated, the lid 200 is made of a plastic material and molded as a single piece. However, the lid 200 may be made of any desired material and the rib 208 may be made of an elastomeric type material, e.g., rubber, and placed in a mating peripheral groove provided on the internal projecting portion 207.

Figure 11:
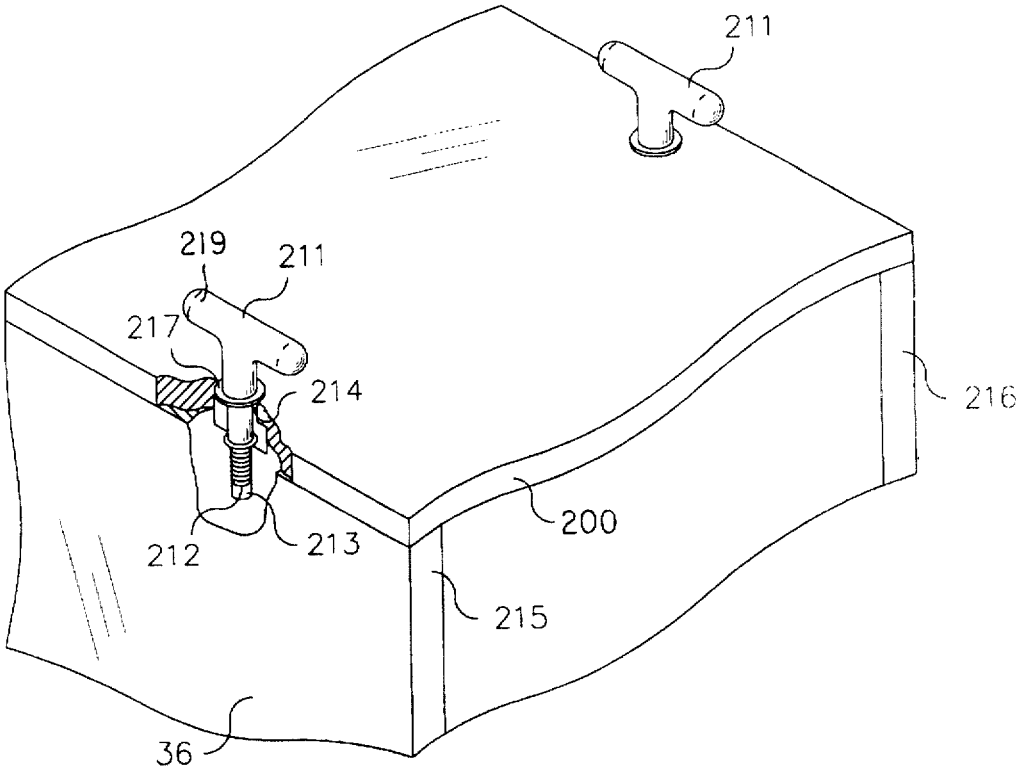
FIG. 11 is a perspective view of a portion of the modular processing section of the apparatus of FIG. 1 illustrating an alternate means for securing the associated lid.

Referring to FIG. 11, there is illustrated a means for securing lid 200 to tank 36. In particular, there is provided a pair of handle screw members 211 each having a threaded shaft 212 which extends through an opening 214 in lid 200 and threadingly engages a corresponding threaded opening 213 in the adjacent side walls 215,216 of tank 36. A flange 217 is provided on shaft 212 for limiting movement of the member 211 by engaging the top surface of the lid 200. By turning the members 211 in a first direction causes the members 211 to engage the threaded openings 213 bringing the lid 200 in sealing relationship with the tank. When the member 211 is rotated in the opposite direction, this will disengage the member 211 from the openings 213 so as to allow removal of the lid 200. The members 211 are each provided with a hand holding section 219 shaped such that it can be used for lifting and carrying of the tank assembly in the engaged position, and lifting of the lid when in the un-engaged position.

Figure 12:
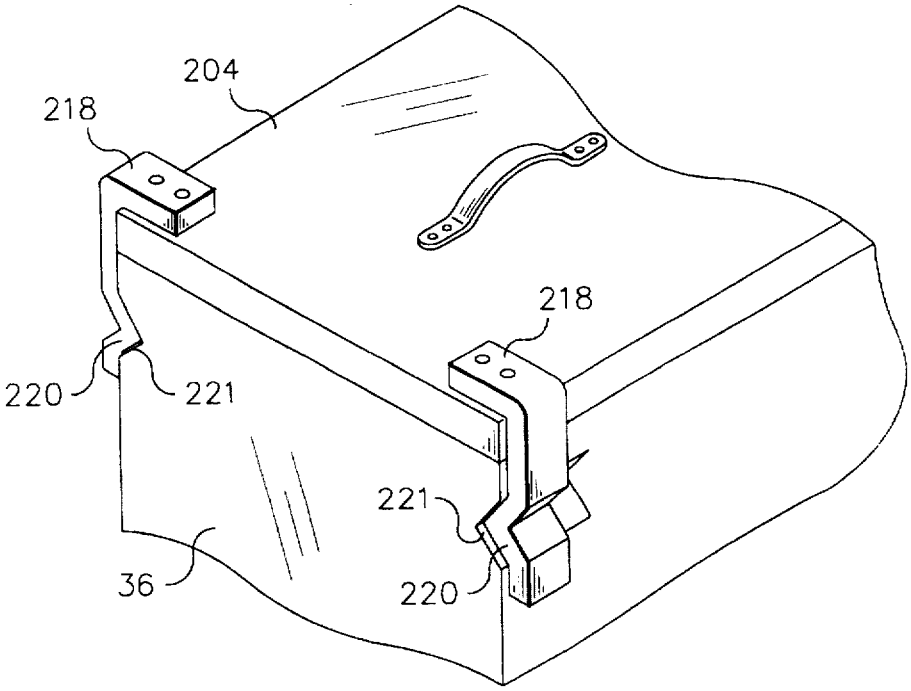
FIG. 12 is a perspective view of a portion of the modular processing section of FIG. 1 illustrating yet another method for securing the associated lid.

Referring to FIG. 12, there is illustrated an alternate means for securing the lid 204 to the tank 36. In this particular embodiment, a flexible spring member 218 is provided at each corner which has a distal end having a projecting member 220 which engages a correspondingly shaped recess 221. The members 218 simply engage or disengage by either pushing the lid 204 downwards so as to deflect members 218 until they reach their respective recess 221 wherein the projecting portion 221 engages the recess 221. To disengage, the members 218 are simply pulled in a direction to lift the lid 204 from the tank.

Referring to FIG. 13, there is illustrated additional means for identifying the particular type of tank being inserted. Each tank is designed to hold a particular type processing solution. For example, but not by way of limitation, the tank may be designed to hold a developer, a bleach, a fixer, a wash, stabilizer, or any other appropriate processing solution. In order to further assure that appropriate tanks are placed at the right position in apparatus 10, in addition to providing physical means for identifying particular solutions such as the projections 193,202 illustrated in FIG. 9, additional means may be provided to further identify and double-check as to the appropriate type container/tank and particular type processing solution contained therein and also provide means for keeping track of the age and history of the processing chemicals. For example, as illustrated in FIG. 11, a bar-code 226 can be placed on the back side wall 228 of tank 36 at a location such that it will be adjacent a bar-code reader 236 that is secured to the adjacent modular recirculation section or frame 14. Thus, when the tank is properly seated, the bar-code reader 230 will read bar-code 226 to identify the particular type tank it is and the particular type processing chemicals contained therein. The CPU 10 can also keep a running history of the processing chemicals to assure that appropriate requirements are maintained.

As previously discussed, projection 193 is a used to stop incorrect placement of one type tank at a particular location. In place of providing a projection such as 193, a recess 232 may be provided in the back side wall 228 of the tank which will engage a microswitch 234 provided in the recirculation module or base upon which the tank rests. The microswitch 234, if not properly engaged in the corresponding recess 122, will provide an appropriate signal to the CPU identifying that an incorrect tank has been placed in that position or that the tank is not properly seated. This information can be used to display a warning to the operator and prevent operation of the apparatus.

Figure 15:
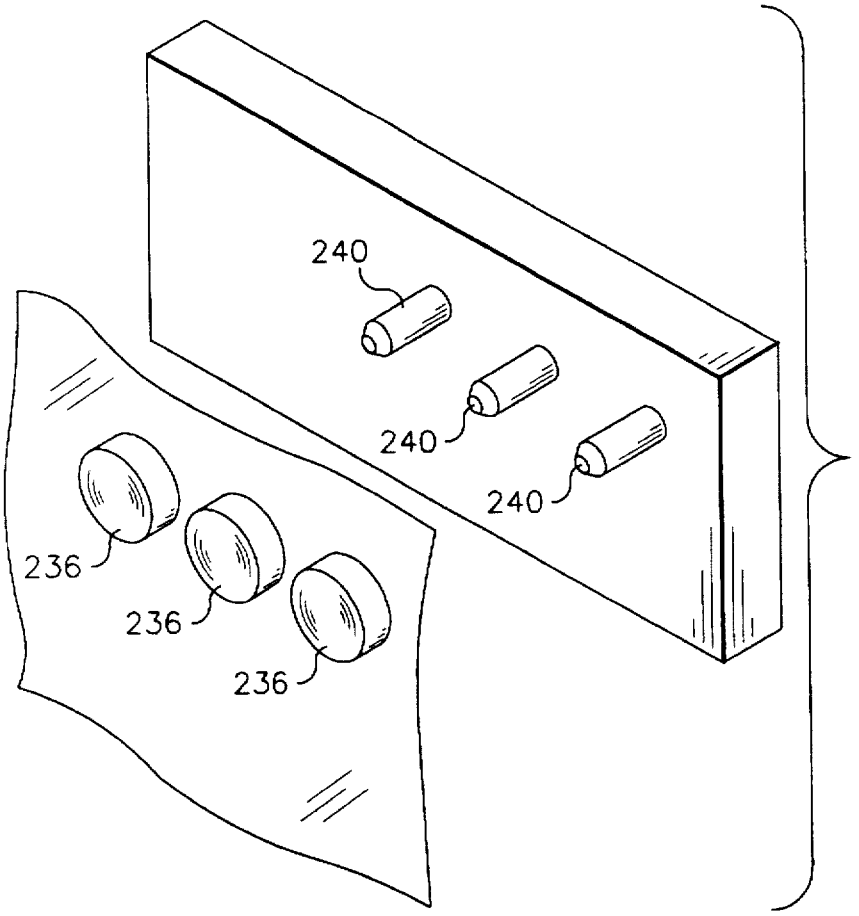

FIGS. 14 and 15 illustrate further alternate means for identifying particular type tanks and processing chemicals. For example, in FIG. 14, a pair of recesses 236 are provided in side wall 238 of tank 36 which mate with a pair of logic pin assemblies 240. The logic pin assemblies 240, if not properly engaged, will produce a signal and send it to the CPU identifying that an incorrect tank has been placed at that location. FIG. 15 illustrates a three logic pin arrangement which is designed to engage two openings. The number and locations of the pins may be adjusted to identify as many types of processing solutions as desired.

Figure 16:
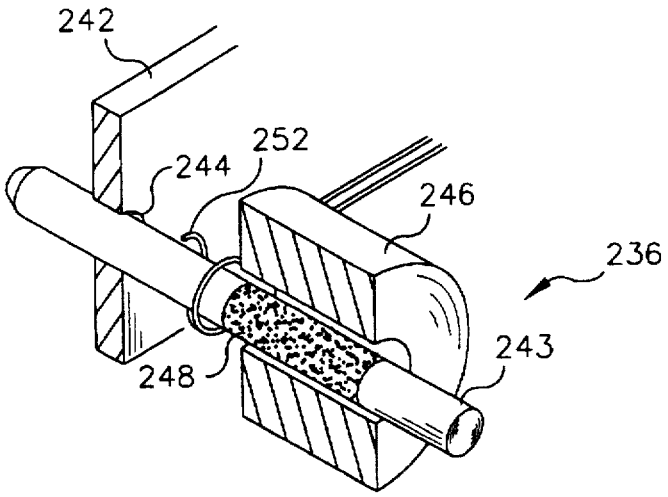
FIG. 16 is a cross-sectional view of the means employed in FIGS. 14 and 15 to identify the attribute of the processing section.

Referring to FIG. 16, there is illustrated one of the logic pin assemblies 240 used in FIGS. 14 and 15. In particular, the logic pin assemblies 240 each include a front plate 242 having an opening 244 through which a pin 243 passes. The assembly 240 further includes a magnetic collar 246 which surrounds a magnetic portion 248 in pin 243. A spring 252 is used to bias pin 243 in a predetermined position. When the pin 243 is not in the appropriate position, and/or when the pin 243 is in the appropriate position, as illustrated in FIG. 16, an appropriate signal is sent to the CPU indicating that the particular pin is in the appropriate position. However, if any one of the pins 243 of pin assemblies 2240 are not in the appropriate position, this information will be passed onto the CPU, whereby the apparatus 10 will be prevented from being operated in this condition and the appropriate error message or warning will be provided. It is, of course, understood that various other logic and type devices may be used for indicating incorrect placement of the correct tank.

Figure 17:
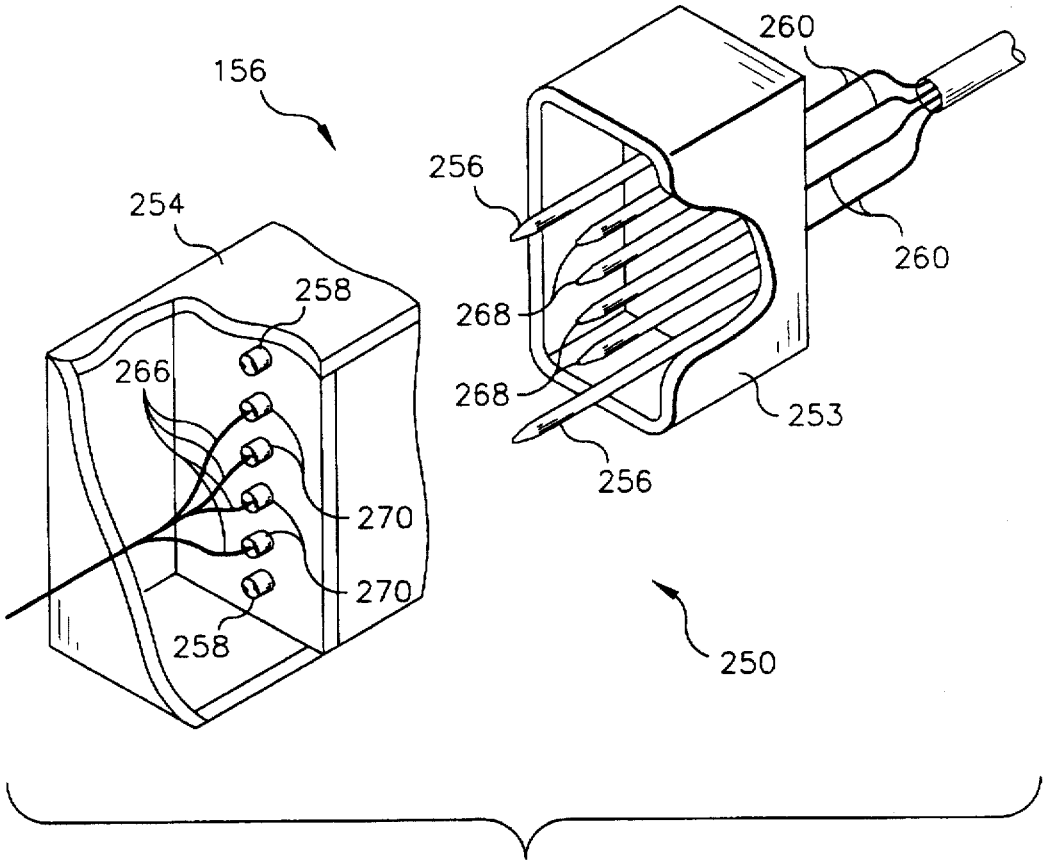
FIG. 17 is a perspective view of an electrical connection used for connecting wires in a modular processing section with wires of the apparatus of FIG. 1 for conveying data to the central computer for other component.

Referring to FIG. 17, there is illustrated an electrical connector 250 having a male section 253 and a female section 254. Either the male or female section is connected to the tank, and the other section is connected to the base and/or modular recirculation section associated therewith. When the tank is properly engaged in the seated position for operation, locating pins 256 provided in male section 253 will properly engage openings 258 in female section 254, thereby allowing electrical connection between electrical wires 260 in male section 253 and wires 266 in female section 254. The electrical wires 264 are connected to pins 268 which engage female connection 270 which are connected to wires 266. The wires 266 are each connected to various type sensors, for example sensors for measuring the temperature, fluid level, and any other desired feature or condition of the processor. The information obtained by the various sensors is relayed to the CPU through wires 266. The electrical connections and fluid connection are such that electrical connections are provided when the tank is fully seated in apparatus 10 and ready for operation. If the CPU senses that appropriate amount of fluid or electrical connection has not been achieved, the CPU will prevent operation of the apparatus until this fault is corrected.

Figure 18:
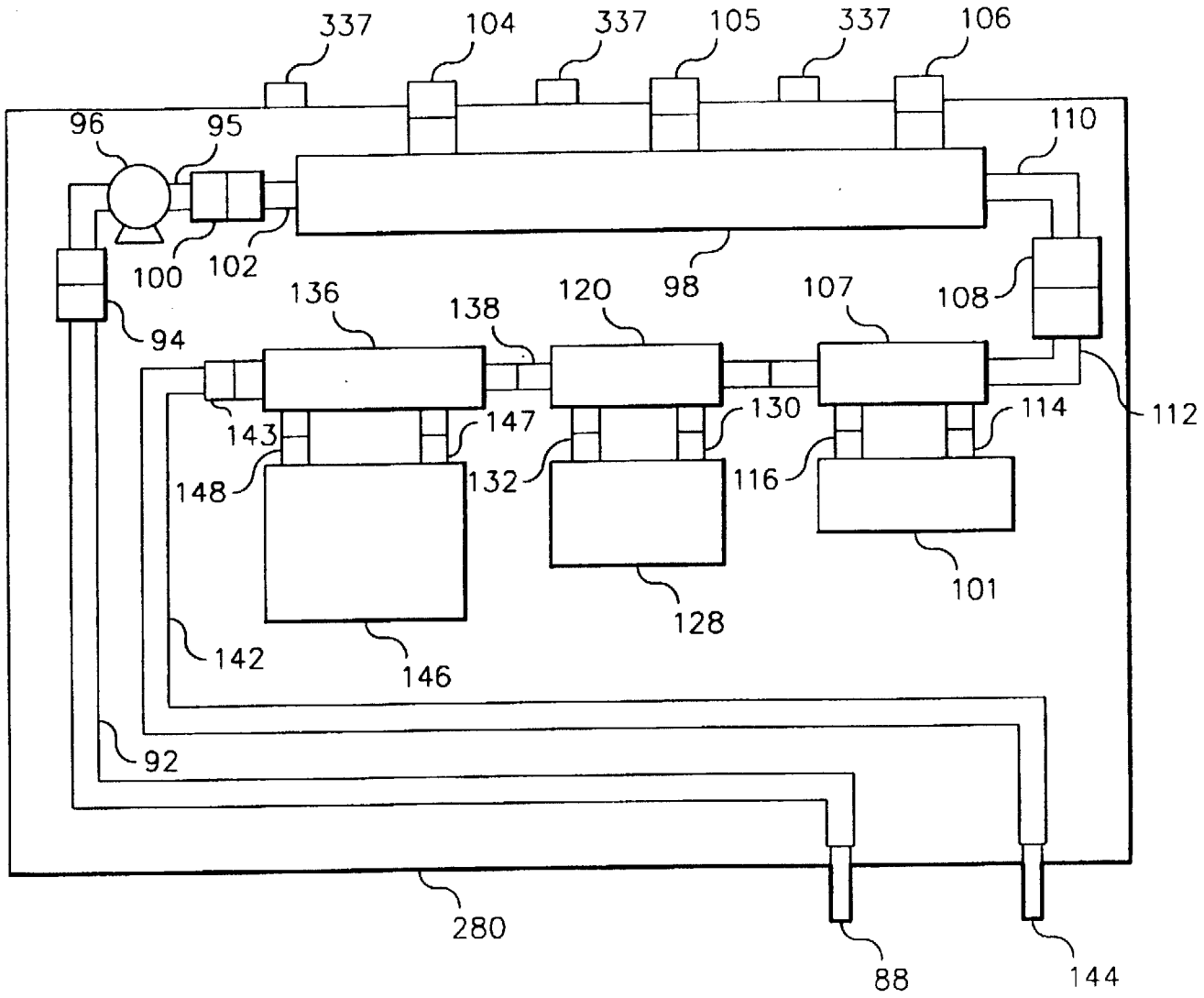
FIG. 18 is an elevational view of one of the modular recirculation sections of the apparatus of FIG. 1.

Referring to FIG. 18, there is illustrated an elevational view of modular recirculation section 62 which is designed to be mounted to frame 14 by any desired mounting technique. The modular recirculation section 62 includes parts previously described and illustrated in FIG. 5, like numerals indicating like parts. In particular, the modular recirculation section 62 includes a housing 280 upon which the various components are mounted. It is to be understood that the components may be mounted by any appropriate technique and in any particular configuration. Additionally, modular section 62 may be modified to provide additional items not shown, or by the elimination of certain elements/parts not needed. For example, if the heater 101 is not needed, it can be simply removed or bypassed. The recirculating processing solution would simply flow through manifold 99. The modular recirculation section 62 includes the male half valve section 160 of connectors 103,104,105 which are designed to be connected to female section 162 of replenishment modular section 72.

Figure 19:
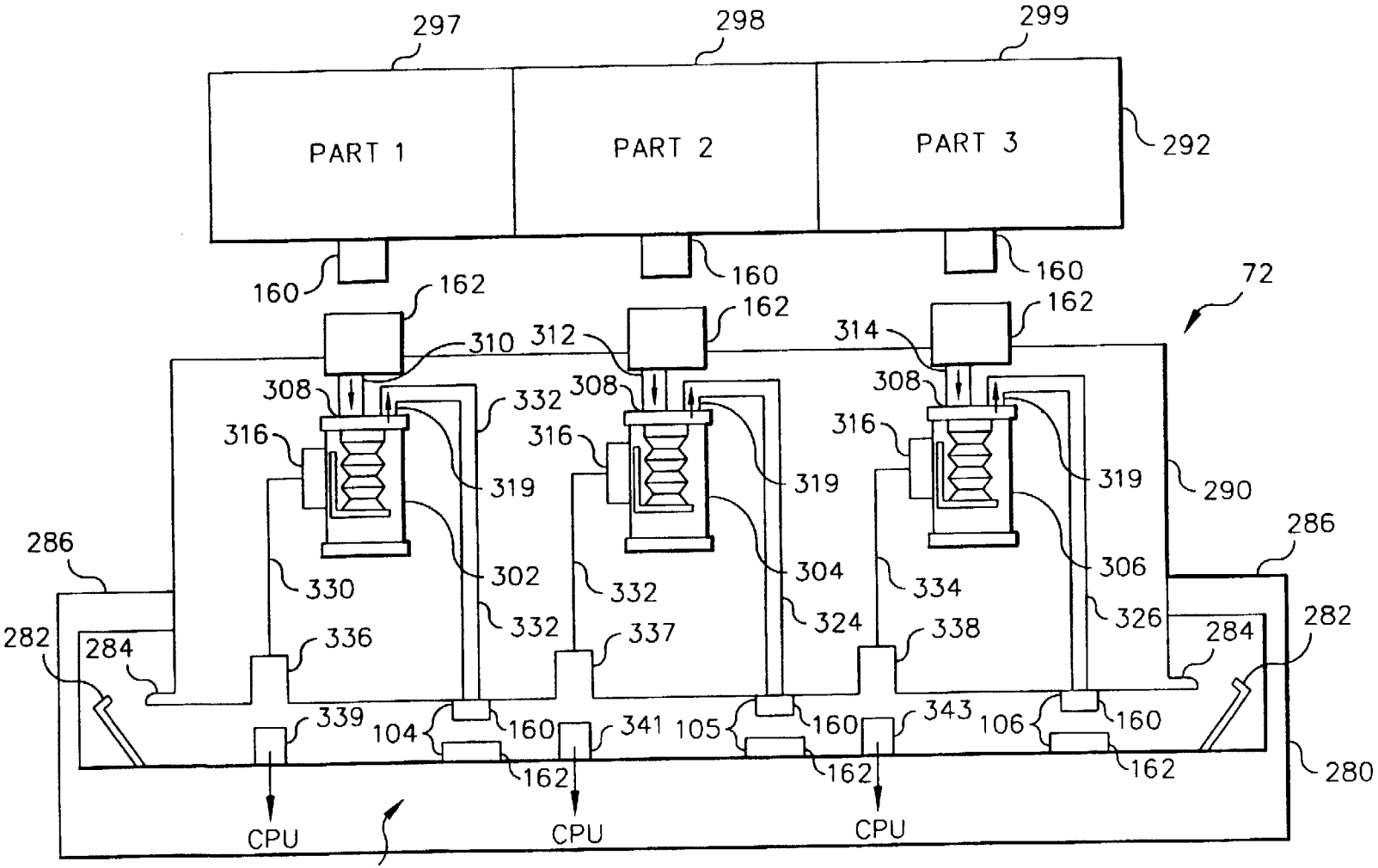
FIG. 19 is an elevational view of one of the modular replenishment sections of the apparatus of FIG. 1 and a portion of the modular recirculation section with which it is associated.

Referring to FIG. 19, there is illustrated an elevational view of modular replenishment section 72 which includes elements illustrated in FIG. 5, like numerals indicating like parts. The modular replenishment section 72 may be attached directly to the frame or base. Preferably, as illustrated, means are provided for detachably mounting the replenishment section 72 to the associated modular recirculation section 62. In the particular embodiment illustrated, the modular replenishment section 72 is secured by over-the-center latches 282 which engage projection 284 on section 72. A pair of guide members 286 are provided for guiding the attachment and positioning of the two sections. Replenishment section 72 includes a housing 290 having a replaceable replenishment reservoir section 292 for supplying the individual chemical processing component used to make the replenishment solution. In the embodiment illustrated, a three-part system is used, thus, section 292 comprises three separate fluid containing compartments 297,298,299, each compartment containing a different chemical component. While each of the compartments are illustrated as having the same size, each compartment may be sized in the appropriate ratio so that each compartment will be emptied at substantially the same time. Each compartment includes a half male valve section 160 which is designed to engage an associated female half valve section 162 so as to provide a dripless valve connection. FIG. 19 illustrates the compartment 292 just prior to engagement with housing 290. Housing 290 includes three pumps 302, 304,306, each having an inlet 308 in fluid connection to its associated female half valve section 62 by conduits 310, 312,314, respectively. A motor 316 is provided in association with each of the pumps 302,304,306 for accurately providing the appropriate amount of chemical solution from each compartment. The outlet 319 of each of the pumps 302,304,306 is fluidly connected to the male half valve section 160 of connections 104,105,106 respectively, by conduits 322,324,326. Each motor is electrically connected and controlled by the CPU through wire cables 330,332,334 through connectors 336,337,338 which mate with connectors 339,341,341.

In the particular embodiment illustrated, liquid replenishment solutions are provided. However, the present invention is not so limited. For example, solid material in the form of tablets, particles, flakes, etc., may be provided whereby the replenishment solution is mixed in desired quantities in the modular replenishment section 72 and then forwarded to the recirculation section 62.

The present invention provides a system that allows versatility in both converting the apparatus to various type chemistries, but also allows customizing of chemistries. Additionally the present invention provides for the quick and easy replacement of various sections and/or components for repair, maintenance or for any other reason. The providing of modular tanks, recirculation sections, and replenishment sections allows the photofinishing manufacturer or the photofinishing operator to construct or modify a photographic processor to handle any desired photographic material, e.g., paper or film, and any desired processing chemicals with minimal effort. The present invention also provides for simple and easy incorporation of future developments. The expandable feature of the apparatus allow for greater versatility for the user with a minimal cost and time. The various safeguards provided by the present invention also minimize the risk that an incorrect tank will be placed in the apparatus for processing any particular type photographic material. Information regarding how the apparatus is to be operated is initially entered into the CPU, for example, the photosensitive material to be processed and the type processing chemicals to be utilized. The CPU is preprogrammed with the recommended chemical processing parameters for each photographic material to be processed. The appropriate modular tanks and recirculation sections and replenishment section are mounted to the apparatus 10. Sensors provided on the apparatus send information to the CPU as to the actual sections and tanks that have been mounted to the apparatus. This information is automatically compared with the selected settings preprogrammed into the apparatus 10 for the particular processing selected or programmed. If all is in order, the apparatus will operate. However, if all is not in order, the CPU will prevent operation until corrective measures are taken to correct the setup. If desired, appropriate override controls may be incorporated so that the operator can disengage the lockout features so that different type chemistries can be used to obtain the desired effect to the photofinishing processing, for example, for pushing of a chemical process for achieving a desired artistic effect or for any other reason.

The present invention also allows the user to follow the history and use of the apparatus and the various components used on the apparatus. For example, each of the modular section and/or component can be provided with an identification number for that particular section or component. This information can be automatically read form the module or component when it is installed on the apparatus 10 by appropriate sensors provided, or manually entered. This information can be read and stored in the CPU for reference by the user. Thus, the user can monitor the history of the apparatus and the various individual modules and/or components used and the various chemical processing solutions contained in the various tanks and components. This information can also be used to assist in diagnosing any processing problems being experienced by the apparatus. The modularity of the apparatus also assists in trouble shooting processing problems and parameters.

The present invention is also very useful for use in research and development efforts in evaluating new and different processing set-ups. The quick and easy conversion of the processor allows the product developer to investigate various different systems and also allows quicker and more efficient testing at research locations and at beta test sites which can result in reducing the time it takes to get a new product to market.

In addition to the ability of handling different types of processing chemicals, the present invention provides the ability to change any one of the individual components separately in the recirculation section and/or replenishment section, allowing for further customization of the processing system. For example, different type filter assemblies and/or treatment modules may be provided to allow customization of specific processing chemicals. Since dripless type connections are employed throughout, individual components can be quickly and easily changed. Further, since the present invention is directed to a low volume thin tank processing system, relatively little processing solution is contained in the tanks and/or individual components. This minimizes the amount of processing solution that could be wasted if the processing solution degrades and the processing solution within the component must be discarded.

Figure 28:
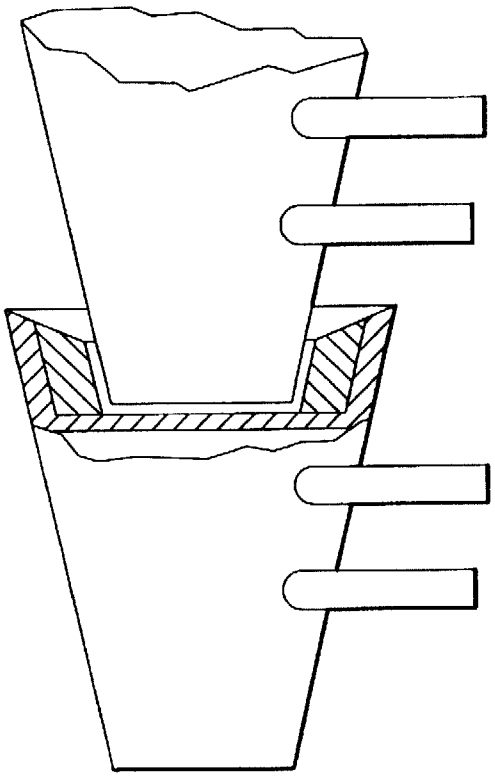
FIG. 28 is a elevational view of a pair of filter assemblies made in accordance with present invention, one stack upon the other.

In order to minimize storage of the individual components, the various components, such as filter assemblies and treatment modules, are designed for stacking. For example, the top of a filter assembly can be configured to receive the bottom of a filter assembly. Thus, they could then be stacked one upon the other minimizing the storage space necessary for maintaining a number of filter assemblies as illustrated in FIG. 28. It is to be understood the various other components, for example heater, treatment cartridges, tanks, etc., can be made to stack in a similar fashion.

In order to further assist in identifying components for particular type processing chemicals, the individual components are color coded in accordance with the color schemes used to identify recirculation sections and replenishment sections. If desired, these individual components can also be provided with means which provide an identifying signal that can be sent to the CPU for identification so that the specific characteristics of that component that can be compared with the required components for the processing chemicals selected.

In many situations in converting from one type processing chemical to another, it is only necessary to change the processing tank. In such a case, the first tank is removed and replaced with a second processing tank containing the desired processing solution. If necessary, a fresh replenishment section containing the desired processing chemicals is secured to the apparatus and fluidly connected to its associated recirculation section. Then, a flushing cycle is conducted wherein a wash or other type solution is circulated through the processing tank and recirculation system and then sent to drain so as to remove any harmful residue remaining from the previous processing chemicals. This flushing cycle can also be applied if one of the components is replaced and there is a need to flush the system. Thereafter, fresh processing chemicals are provided to the processing tank and the apparatus is operated in its normal manner. The use of a low volume thin tank type processor (LVTT) with the present invention further minimizes loss of processing solutions if and when the processing solution must be replenished and/or discarded.

As illustrated in FIG. 2, more than one film path is provided for processing the photosensitive material through the processor at one time. In the particular embodiment illustrated, at least three different photosensitive materials may be provided. Thus, there exists the possibility of processing two different types of material wherein certain processing solutions may be passed through for one type photosensitive material and certain other tanks are used for other types of material.

Figure 20:
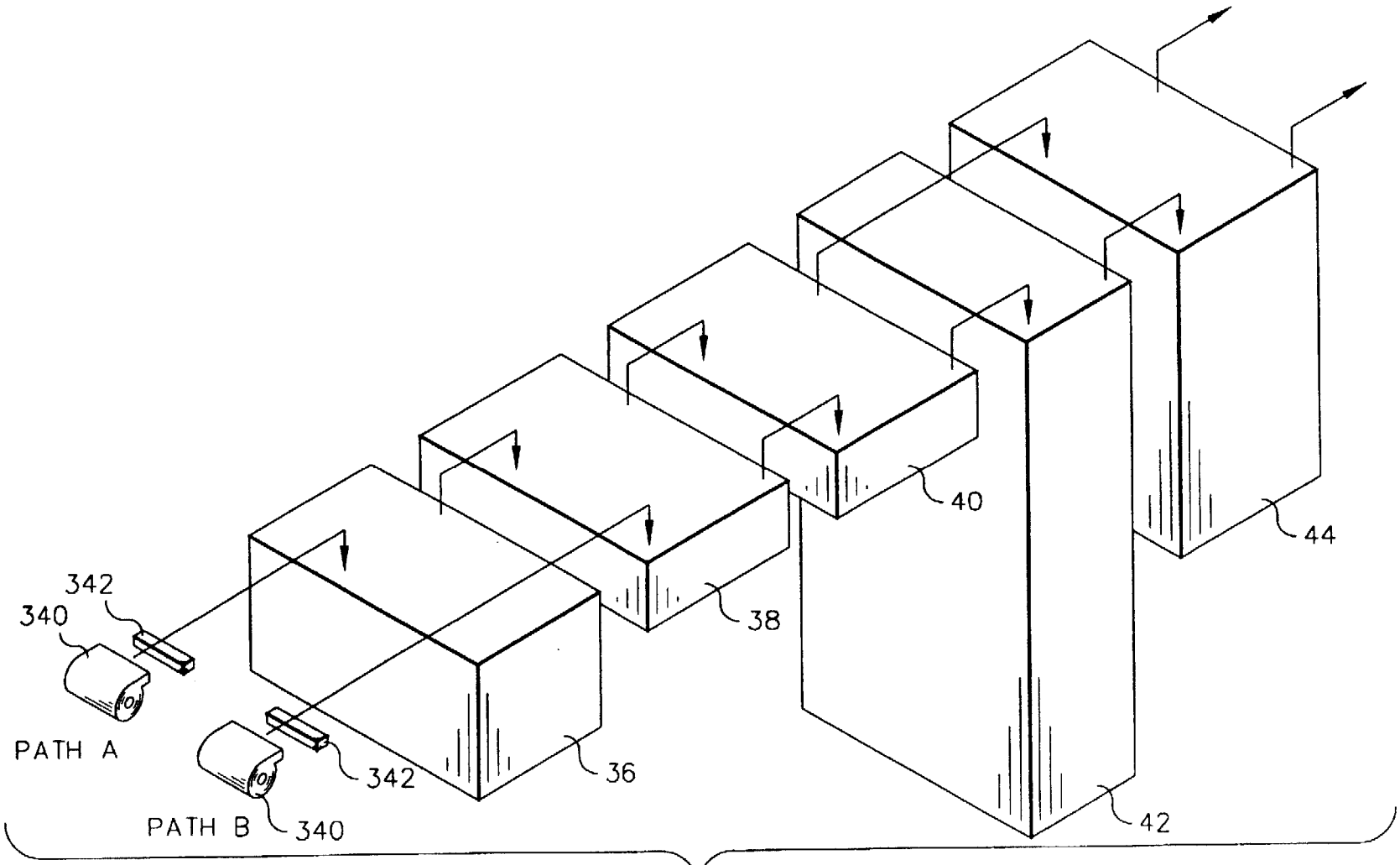
FIG. 20 schematically illustrates two different processing paths which a photosensitive material may take through the apparatus of FIG. 1.

Referring to FIG. 20, there are schematically illustrated two different paths A and B that the photosensitive material may take through the processing tanks 36,38,40,42,44. In the embodiment illustrated, the film is illustrated coming out of supply cartridges 340 and past bar-code scanner 342. The scanner 342 will identify the type of photosensitive material to be processed through paths A and B. This can be compared with the photoprocessing chemicals setup for each path as determined by the CPU and if there is any consistency between the type of processing chemicals necessary to process the photosensitive material and the processing chemicals placed in the apparatus through which it is to be passed. An error message may be displayed and/or stopping of the device may occur until such situation is appropriately corrected or overridden as desired by the operator.

Paths A and B illustrate different paths for the different photosensitive materials. Path A is similar to path B, except that the photosensitive material does not pass through tank 42. It is to be understood that any desired processing path may be made. As additional tanks are provided, various additional different paths may be established for various different photosensitive materials.

Figure 21A:
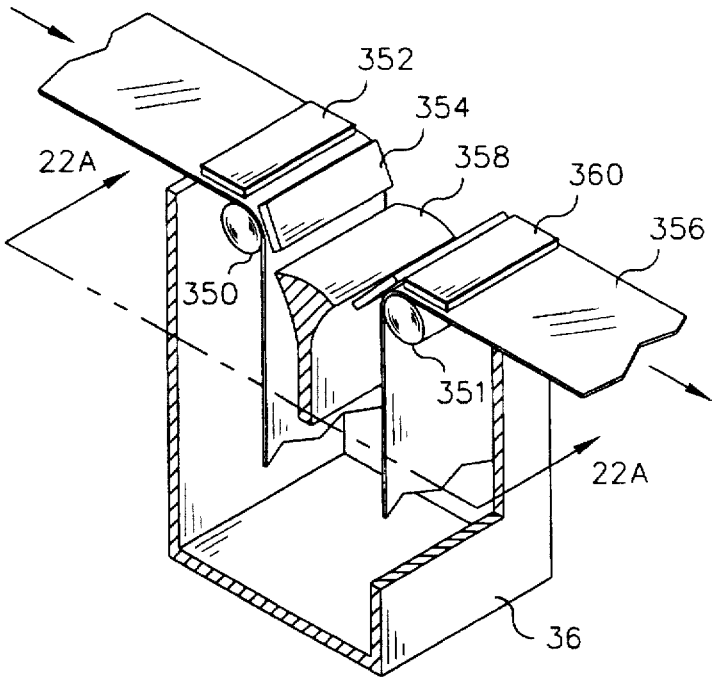
FIG. 21A is a perspective view of a diverting mechanism that can be used to divert a photosensitive material to pass within a particular processing section or pass the photosensitive material onto the next processing section. The mechanism is illustrated in the mode for diverting the photosensitive material into the processing section.
Figure 21B:
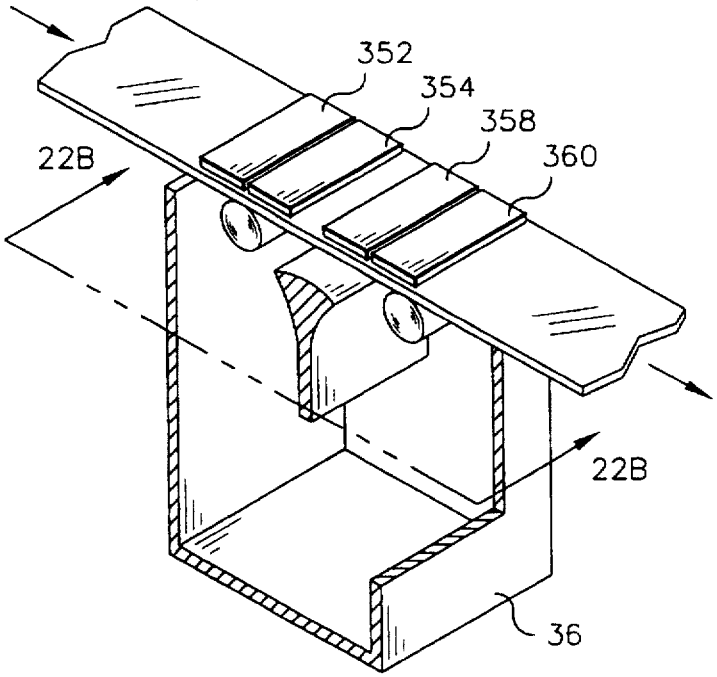
FIG. 21B is similar to FIG. 21A, illustrating the diverting mechanism in the mode for passing the photosensitive material onto the next processing section.

Referring to FIGS. 21A and 21B, there is illustrated a mechanism 348 used for transporting and diverting photosensitive material through or past each of the tanks. In particular, there is provided a first guide roller 350 and an adjacent pair of guide members 352,354 located at the entrance of channel 84 of tank 36. Similarly, an exit guide roller 351 is provided at the exit of the channel 84 of tank 36 which also has a pair of guide members 358,360 associated therewith. In FIG. 21A, the members 352,354,358, 360 are positioned to direct paper into and out of the processing tank. Referring to FIG. 21B, the members 352, 354,358,360 are moved to a disengaged position which results in the photosensitive material bypassing the tank 36 and moving over to the next processing tank where the photosensitive material will then be passed through.

Figure 22A:
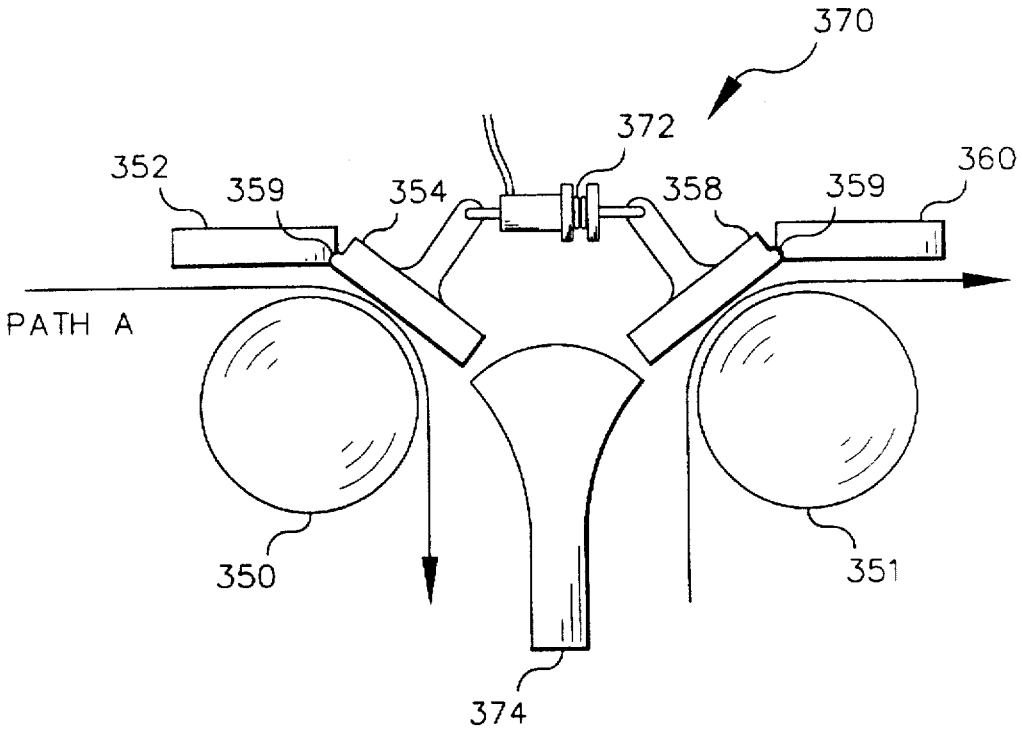
FIG. 22A is a side view of the diverting mechanism of FIG. 21A as taken along line 22A—22A.
Figure 22B:
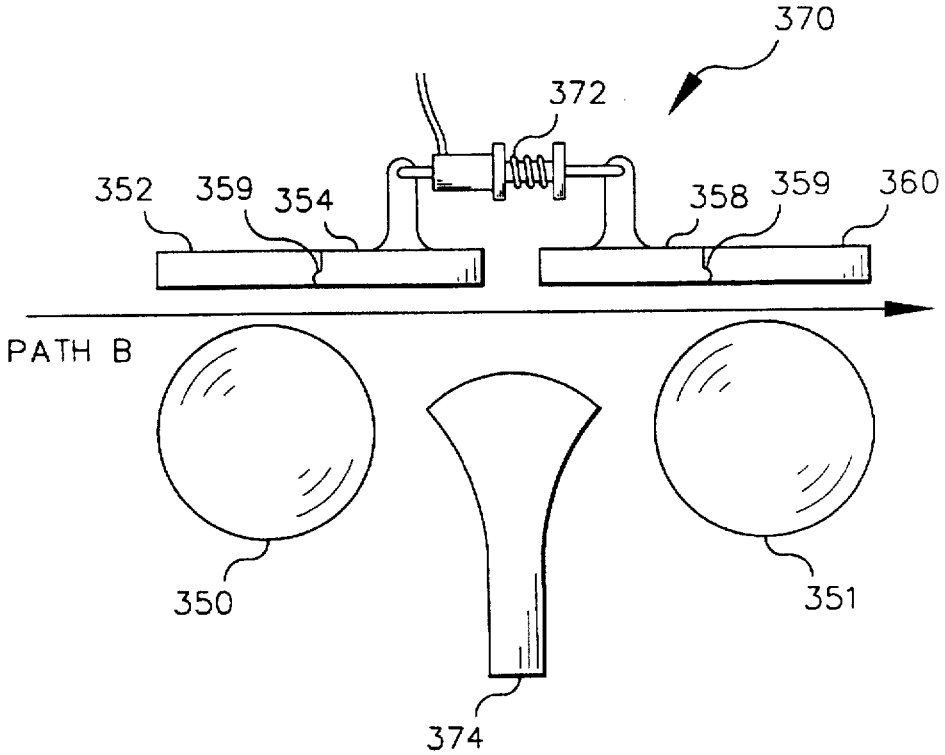
FIG. 22B is a side view of the diverting mechanism of FIG. 21B as taken along line 22B—22B.

FIGS. 22A and 22B are side elevational views of FIGS. 21A and 21B, respectively, illustrating a mechanism 370 which may be used for positioning of the guide members 352,354,358,360 in the engaged or disengaged position. In particular, there is provided a solenoid 372, as illustrated in FIG. 22A, which engages a diverting member 374 having a configuration which causes the photosensitive material in conjunction with the guide members 352,354,35,360 to go into and exit the processing tank, and when in the position illustrated in FIG. 22B, guides the photosensitive material such that it passes onto the next processing station. As illustrated in FIGS. 22A and 22B a path A is formed between the guide rollers 350, 351, guide members 352,354,358,360 and diverting member 374 for guiding the photosensitive material into and out of the tank. When it is desired to by-pass a particular tank, the solenoid 372 is energized so as to move members 354 and 358 such that the photosensitive material is diverted past the tank as illustrated by path B in FIGS. 21B and 22B. In the embodiment illustrated, the guide members 354,358 pivot about hinge point 359. Also in the embodiment illustrated, a single diverting member 374 is used, however, depending on the size of the tank, two individual diverting members 374 may be used, one at the entrance of the tank and one at the exit of the tank. It is, of course, understood that various other mechanisms may be used as appropriate or desired.

Figure 23:
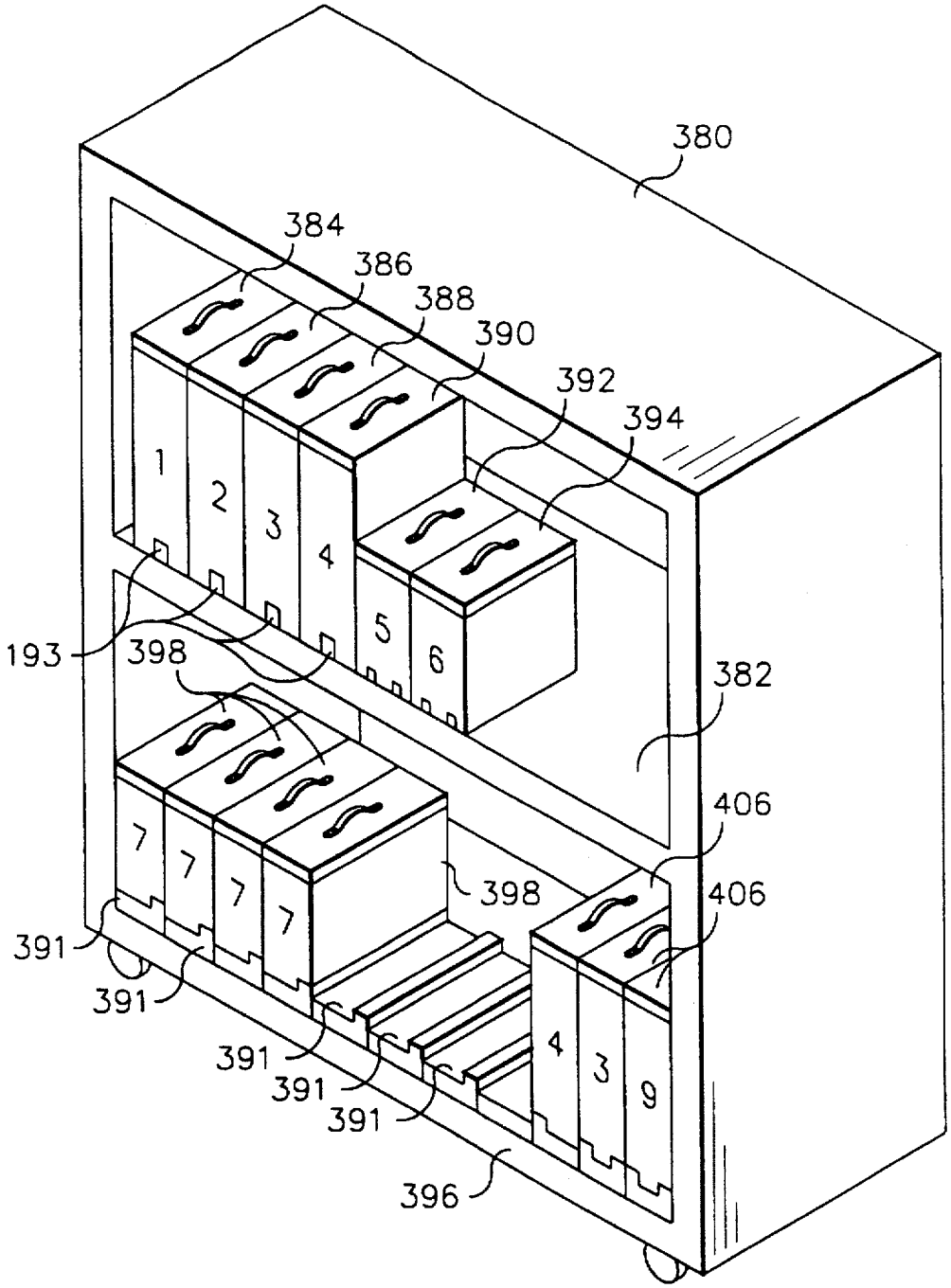
FIG. 23 is a perspective view of a storage cabinet for storing of the modular processing sections of FIG. 1.

Referring to FIG. 23, there is illustrated a storage container 380 having a shelf 382. As can be seen, a plurality of developer tanks 384,386,388,390 (tanks that are designated to hold developer processing solution) are stored on shelf 382. In the particular embodiment illustrated, each of the tanks is assigned to hold a different processing chemical which can be identified by an appropriate bar-coding on the back. Additionally, a color coding scheme can be used to identify the type of tank and processing chemicals contained therein. For example, tank 384 can be directed to process C-41 developer and tank 386 can be directed to process RA-4 developer. Likewise, tank 388 could be directed to process E-6 developer and tank 396 could be directed to black and white developer. These features of the tank can all be identified by providing different colors for different processing chemicals. For example, tanks that contain developer solution can be red with different shades identifying different developer chemistries. The opening 194 on the bottom will also indicate that they are all developer tanks. Likewise, tanks 392,394, which are directed to bleach tanks, can be similarly identified.

In the embodiment illustrated, the tanks are simply placed on shelf 382 in a storage cabinet. However, if desired, the tanks may be placed on an associated base 391 on lower shelf 395 as illustrated FIG. 23. As can be seen, a plurality of tanks 398, e.g. wash tanks, are provided along with their associated bases 391. Additionally, stabilizer tanks 406 are also illustrated. It is to be understood that various types of color schemes and shaped locating projections may be provided for easy identification. Likewise, the tanks can all have bar-codes which can be read by appropriate means to identify not only the particular type of tank it is, but the type of processing chemicals contained thereon. If desired, the tanks may be placed in a climate controlled environment to further enhance the storage life of the processing chemicals.

Figure 24:
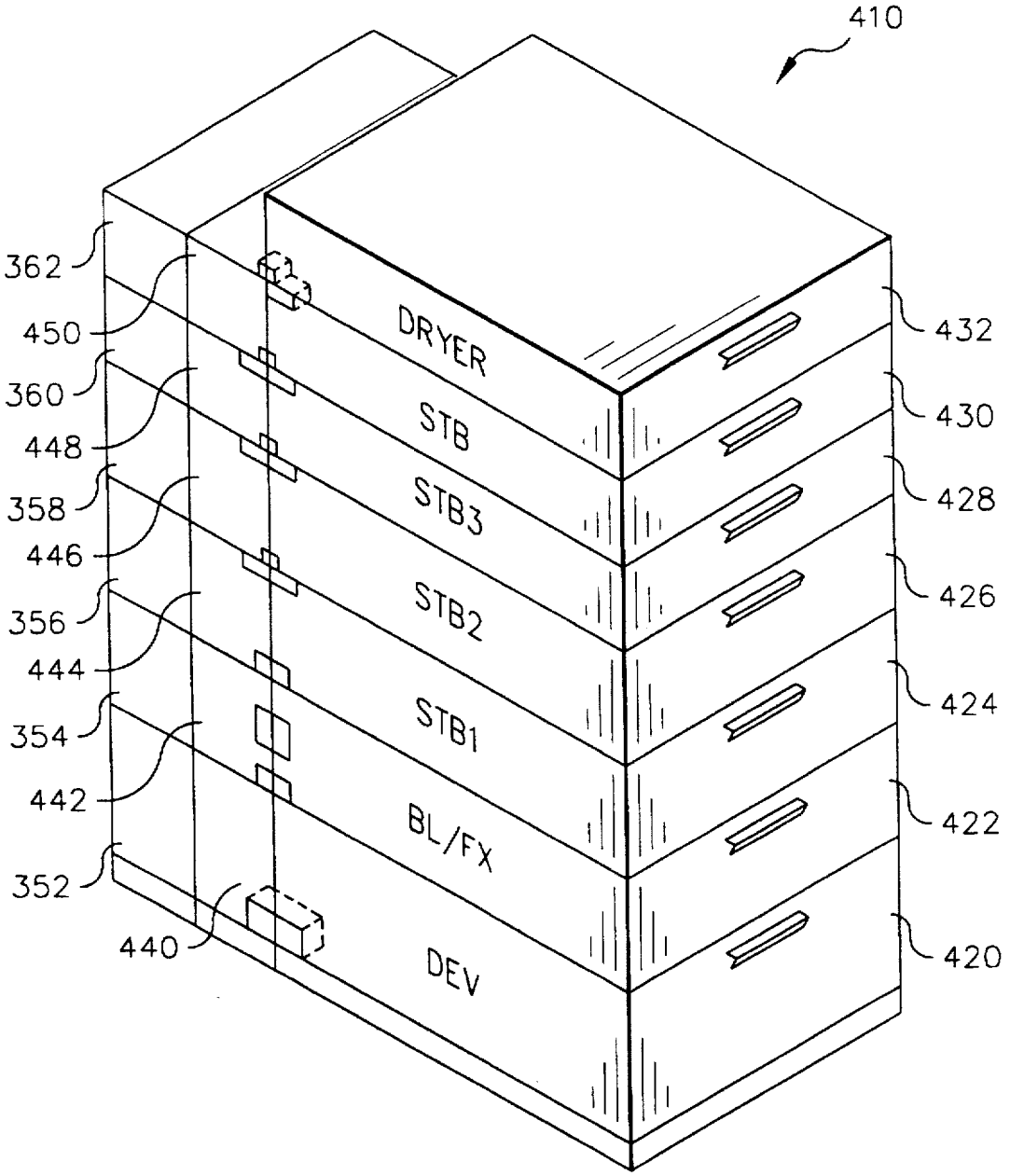
FIG. 24 is a perspective view of a modified processing apparatus made in accordance with the present invention.
Figure 25:
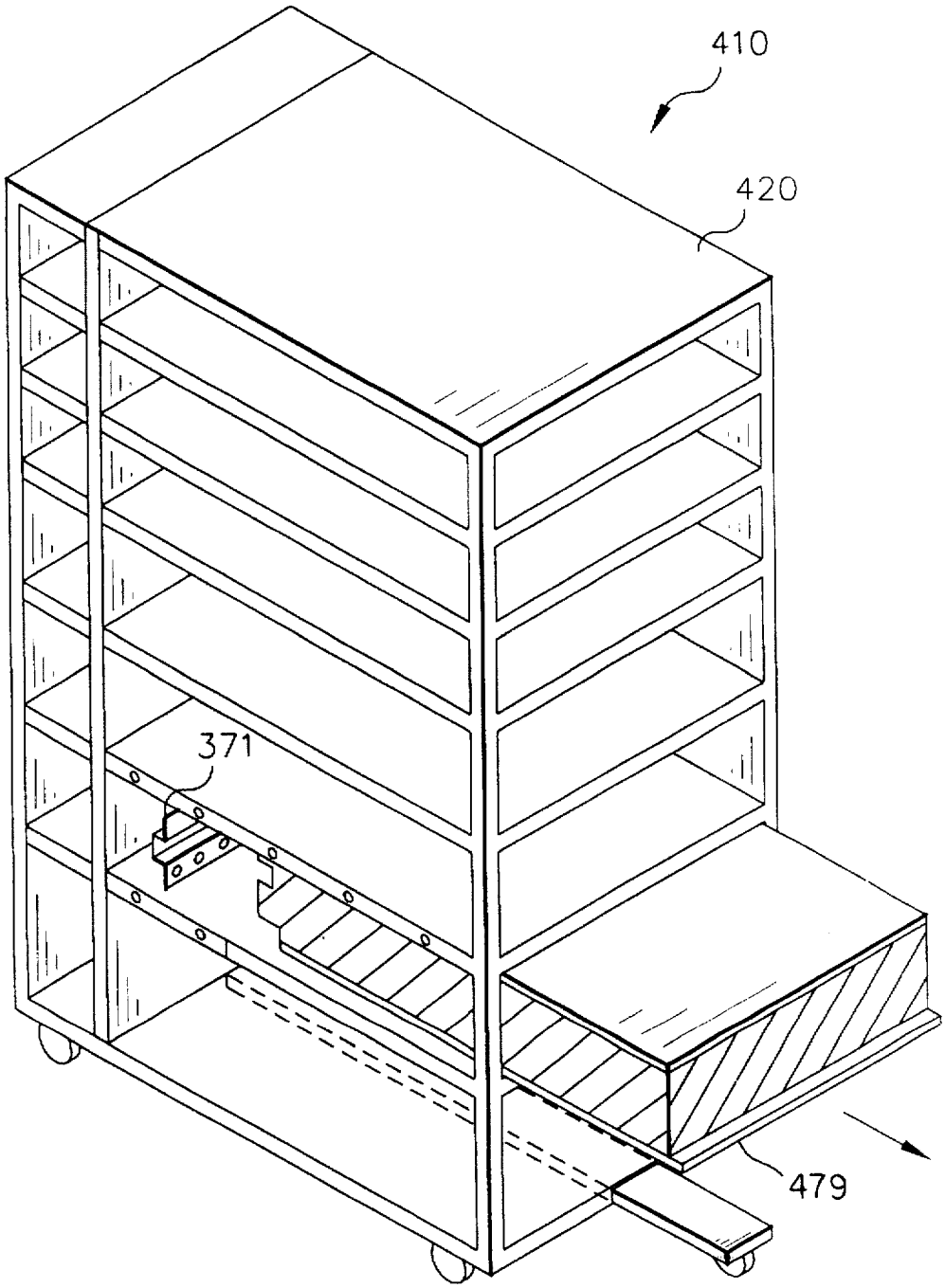
FIG. 25 is a perspective view of the apparatus of FIG. 24 with the outer housing removed so as to illustrate the internal construction of the apparatus.
Figure 26:
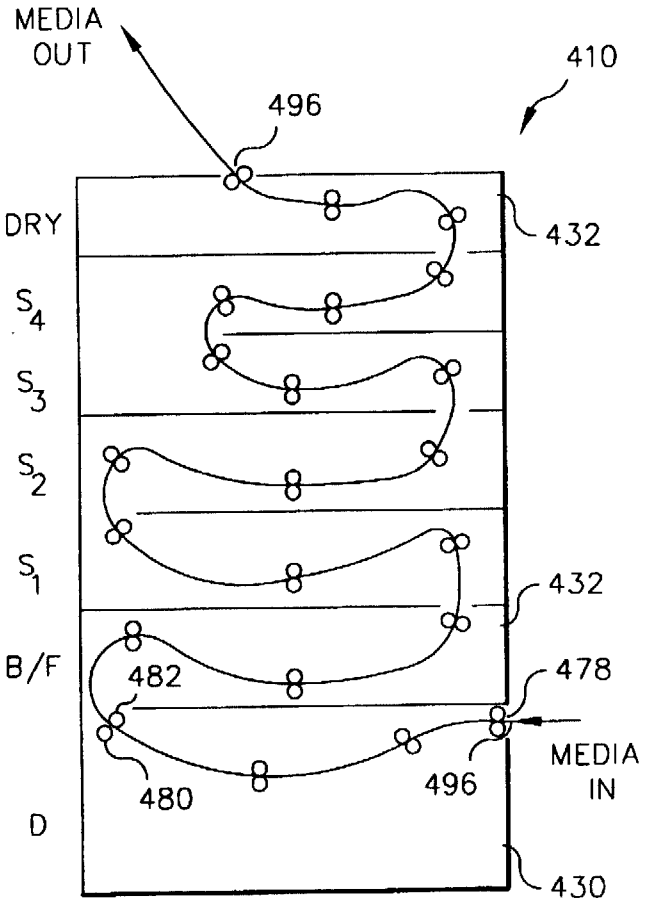
FIG. 26 is a schematic representation of the apparatus of FIG. 24 illustrating the path of the photosensitive material therethrough.
Figure 27:
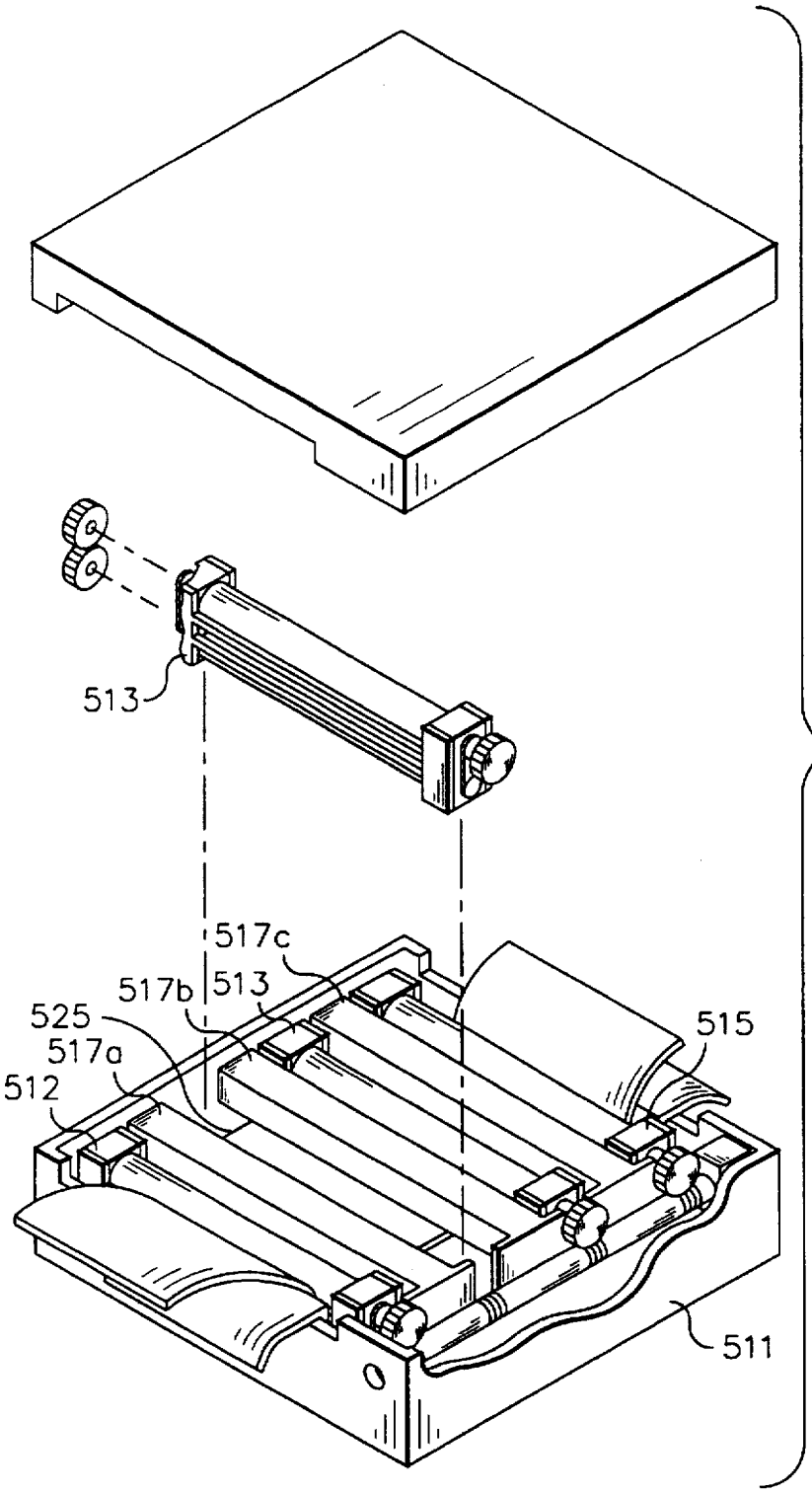
FIG. 27 is a perspective view of processing module that can use in the present invention.

Referring to FIGS. 24, 25, and 26, there is illustrated an apparatus 410 made in accordance with the present invention. Apparatus 410 is similar to apparatus 10 in concept and operation, like numerals indicating like parts and operation. However, instead of having a plurality of processing tanks placed side by side, the processing tanks of apparatus 410 are positioned in a vertical stacked arrangement. Apparatus 410 can employ low volume thin tank processing modules such as illustrated and described in U.S. Pat. Nos. 5,420,658; 5,347,337; and 5,335,190; which are hereby incorporated by reference. The apparatus 410 includes a plurality of modular processing modules 420,422,424,426,428,430, and dryer 432. An example of a suitable construction for the modules 420,422,424,426,428,430 is illustrated in FIG. 27 wherein there is provided a container 511; an entrance roller assembly 512; transport roller assemblies 513; exit transport roller assembly 515; and high impingement nozzle assemblies 517*a*,517*b*,517*c*. The nozzle assemblies and transport assemblies form a processing channel 525 through which the photosensitive material passes. Appropriate drive means, not shown, are provided for driving the transport roller assemblies. Further details of construction and operation are described in the '658, '337 and '190 references previously referred to and incorporated herein. A plurality of recirculation sections 440,442,444,446,448,450 are provided which are fluidly connected to the adjacent processing tanks, respectively. Adjacent each of the recirculation sections there is provided a replenishment section 352,354,356,358, 360,362, respectively. A dryer module 432 dries the photosensitive material.

As best seen by reference to FIG. 25, the apparatus 410 includes a frame 420 on which the processing modules, recirculation modules, and dryer module are substantially horizontally slideably mounted. The back side of the modules is provided with appropriate fluid connections and electrical connections as previously described and as best seen by referring to FIG. 25 which illustrates an perspective view of a mating section 371 secured to frame 420. In the preferred embodiment, mating section 371 is the front end of the mating modular recirculation section.

In order to provide stability to the apparatus 410, a slideable support member 479 base is provided that can be slid out so that the base will be stabilized so that the modular unit can be slide out with tipping of the apparatus. The member 479 is normally in the retracted position beneath the apparatus so that it is out of the way.

Referring to FIG. 26, there is illustrated in schematic form the path of the photosensitive material as it passes through apparatus 410. The photosensitive material 476 enters into developer section 430 through entrance opening 478 and exits through opening 480, which is aligned with opening 482 of fix tank 432. Likewise, the photosensitive material 476 passes aligned exits and entrances in adjacent tanks until it exits the dryer 432 through exit 496.

For the purpose of the present invention, a low volume thin channel or low volume thin tank processing apparatus (LVTT) shall mean an apparatus wherein the processing section 36 has a small volume for holding processing solution and a narrow processing channel 84 is provided for subjecting the photosensitive material to the processing solution. The processing channel 84, for a processor used for photographic paper, should have a thickness t equal to or less than about 50 times the thickness of the paper being processed, preferably a thickness t equal to or less than about 10 times the paper thickness. In a processor for processing photographic film, the thickness t of the processing channel 25 should be equal to or less than about 100 times the thickness of photosensitive film, preferably, equal to or less than about 18 times the thickness of the photographic film. An example of a processor made in accordance with the present invention which processes paper having a thickness of about 0.008 inches would have a processing channel thickness t of about 0.080 inches, and a processor which processes film having a thickness of about 0.0055 inches would have a processing channel thickness t of about 0.10 inches.

The total volume of the processing solution within the processing section 36 and recirculation section 62 is relatively small as compared to prior art conventional tank type processors. A LVTT processor made in accordance with the present invention is made in accordance with the following relationships:

$$V_S = V_T + V_C + V_R$$

$$V_T \geqq 0.4V_S$$

$$V_C \geqq 0.1VT$$

Wherein:

$V_T$ is the volume of processing solution present in the processing tank or module.

$V_T$ is the volume of processing solution present in the processing channel.

$V_R$ is the amount of processing solution present in the recirculation system for the processing section.

$V_S$ is the volume of processing solution present in the entire processor.

Preferably, a LVTT processor is made in accordance with the following relationships:

$$V_T \geqq 0.5V_S$$

$$V_C \geqq 0.5V_T$$

Most preferably, a LVTT processor is made in accordance with the following relationships:

$$V_T \geqq 0.75V_S$$

$$V_C \geqq 0.75V_T$$

Typically, the amount of processing solution available in the system will vary depending on the size of the processor, that is, the amount of photosensitive material the processor is capable of processing. For example, a typical prior art microlab processor, a processor that processes up to about 5 $ft^2$/min of photosensitive material (which generally has a transport speed less than about 50 inches per minute) has about 17 liters of processing solution as compared to about 5 liters for a processor made in accordance with the present invention. With respect to typical prior art minilabs, a processor that processes from about 5 $ft^2$/min to about 15 $ft^2$/min of photosensitive material (which generally has a transport speed from about 50 inches/min to about 120 inches/min) has about 100 liters of processing solution as compared to about 10 liters for a processor made in accordance with the present invention. With respect to large prior art lab processors that process up to 50 $ft^2$/min of photosensitive material (which generally have transport speeds of about 7 to 60 ft/min) they typically have from about 150 to 300 liters of processing solution as compared to a range of about 15 to 100 liters for a large processor made in accordance with the present invention. A minilab sized processor made in accordance with the present invention is typically designed to process 15 $ft^2$ of photosensitive material per minute and would have about 7 liters of processing solution as compared to about 17 liters for a typical prior art processor.

It is to be understood that various other changes and modifications may be made without departing from the scope of the present invention, the present invention being limited by the following claims.

Parts List

10 . . . apparatus
12 . . . housing
14 . . . frame
16,18 . . . channel members
55,57 . . . processing sections
20,22 . . . slots
23 . . . threaded bolt
25 . . . threaded nut
26 . . . control section
28 . . . control panel
30 . . . loading section
32 . . . openings
34 . . . developing section
36,38,40,42,44 . . . modular processing tanks
40,42,44 . . . tanks
46,48,50,52,54 . . . mounting bases
56,58,60 . . . spacer members
61 . . . dryer
67 . . . exits
62,64,66,68,70 . . . modular recirculation section
72,74,76,78,80 . . . modular replenishment sections
82 . . . rack
84 . . . processing channel
86 . . . outlet
88 . . . dripless valve connection (assembly)
90 . . . inlet
92 . . . conduit
96 . . . pump
94 . . . dripless valve connection
95 . . . outlet
98 . . . manifold
99 . . . outlet
100 . . . quick dripless valve connection
101 . . . heater
102 . . . conduit
104,105,106 . . . dripless valve connections
108 . . . dripless valve connection
110,112 . . . conduits
107 . . . manifold
101 . . . heater
114,116 . . . quick disconnect dripless valve connections
117 . . . outlet
118 . . . inlet
119 . . . fluid outlet
122 . . . quick disconnect dripless valve connection
124,126 . . . conduits
120 . . . manifold
128 . . . filter assembly
129 . . . outlet
131 . . . inlet
130,132 . . . quick disconnect connections
134 . . . outlet
136 . . . manifold
138 . . . quick disconnect connection
139 . . . outlet

140 . . . inlet
142 . . . conduit
143,144 . . . quick disconnect connections
146 . . . treatment cartridge
147,148 . . . dripless valve connections
150 . . . overflow outlet
152 . . . overflow tank
154 . . . conduit
155,156 . . . quick disconnects
141 . . . replenishment tank
160 . . . male half valve section
162 . . . female half valve section
164 . . . body member
166 . . . proboscis member
167 . . . longitudinal channel
170 . . . radial fluid ports
172 . . . fluid passage
174 . . . closed end portion
176 . . . movable block member
177 . . . resilient O-rings
178 . . . spring member
179 . . . shoulder
175 . . . radial flange
181 . . . registration surface
186 . . . body member
188 . . . entrance ports
190 . . . hollow piston
192 . . . spring member
180,188 . . . ports
73 . . . front mating plate
193 . . . longitudinal projection
194 . . . opening
197 . . . bottom mounting surface
191 . . . surface
195,196 . . . side projections
198,199 . . . sides
200 . . . lid
202 . . . projection
203 . . . recess
204 . . . lid
206 . . . opening
208 . . . sealing rib
210 . . . inner surface
207 . . . internal projecting portion
211 . . . handle screw member
212 . . . threaded shaft
214 . . . opening
213 . . . corresponding threaded opening
215,216 . . . side walls
219 . . . hand holding section
218 . . . flexible spring member
220 . . . projecting member
221 . . . recess
226 . . . bar-code
228 . . . back side wall
236 . . . bar-code reader
230 . . . bar-code reader
232 . . . recess
234 . . . microswitch
236 . . . pair of recesses
238 . . . side wall
240 . . . logic pins
242 . . . front plate
244 . . . opening
246 . . . magnetic collar
248 . . . magnetic portion
252 . . . spring
250 . . . electrical connector
253 . . . male section
254 . . . female section
256 . . . locating pins
258 . . . openings
260 . . . electrical wires
266 . . . wires
264 . . . electrical wires
268 . . . pin
270 . . . female connection
280 . . . housing
282 . . . over-the-center latches
284 . . . projection
286 . . . guide members
290 . . . housing
292 . . . replaceable replenishment reservoir section
297,298,299 . . . fluid containing compartments
302,304,306 . . . pumps
308 . . . inlet
310,312,314 . . . conduits 310,312,314
316 . . . motor
319 . . . outlet
322,324,326 . . . conduits
330,332,334 . . . wire cables
336,337,338,339,341,343 . . . connectors
340 . . . supply cartridges
342 . . . bar-code scanner
348 . . . mechanism
350 . . . guide roller
352,354 . . . guide members
351 . . . guide roller
358,360 . . . guide members
359 . . . hinge point
352,354,358,360 . . . members
370 . . . mechanism
372 . . . solenoid
374 . . . diverting member
380 . . . storage container
382 . . . shelf
384,386,388,390 . . . tanks
395 . . . shelf
396 . . . tank
392,394 . . . tanks
391 . . . base
396 . . . shelf
410 . . . apparatus
420,422,424,426,428,430 . . . modular processing modules
432 . . . dryer
511 . . . container
512 . . . entrance roller assembly
513 . . . transport roller assemblies
515 . . . exit transport roller assembly
**517*a*,517*b*,517*c*** . . . high impingement nozzle assemblies
525 . . . processing channel
440,442,444,446,448,450 . . . recirculation sections
470 . . . frame
472 . . . back side
371 . . . mating section
476 . . . photosensitive material
460 . . . developer section
478 . . . entrance opening
470 . . . support member
480 . . . opening
462 . . . fix tank
476 . . . photosensitive material
496 . . . exit

We claim:

1. A modular photographic processor for processing a photosensitive material comprising:

a modular processing section containing at least one removable processing tank for holding a processing solution therein, said at least one removable processing tank having an outlet port and an inlet port, and a modular recirculation system having a first inlet end and a second outlet end, said second outlet end of said recirculation system being connected to said inlet port of said at least one removable processing tank by a first quick disconnect dripless fluid valve assembly, and said first inlet end of said recirculation system being connected to said outlet port of said at least one removable processing tank by a second quick disconnect dripless fluid valve assembly, said recirculation system including at least one fluid processing component which is connected to said recirculation system by at least one third quick disconnect dripless fluid valve assembly;

means for positioning said at least one removable processing tank at a particular location in said processor; and means to prevent operation of said at least one removable processing tank until all appropriate connections have been made to said at least one removable processing tank and said at least one removable processing tank is properly aligned.

2. A modular photographic processor according to claim 1 wherein each of said first, second and at least one third quick disconnect dripless fluid valve assemblies comprises a pair of mating half valve sections that can be quickly connected or disconnected.

3. A modular photographic processor according to claim 1 wherein each of said first, second and at least one third quick disconnect dripless fluid valve assemblies comprises a male first half valve section and a female second half valve section designed to be coupled together so as to provide fluid communication therethrough.

4. A modular photographic processor according to claim 1 wherein said at least one removable processing tank comprises a low volume thin tank processor.

5. A modular photographic processor according to claim 4 wherein said at least one removable processing tank comprises a container, at least one processing assembly placed in said container and at least one transport assembly disposed adjacent said at least one processing assembly, said at least one processing assembly and said at least one transport assembly forming a substantially continuous processing channel through which a processing solution flows, said processing channel comprising at least 40% of the total volume of the processing solution available for the processing tank, the processing channel having a thickness equal to or less than about 100 times the thickness of the photosensitive material to be processed in said processing channel.

6. A modular photographic processor according to claim 1 wherein said at least one processing component comprises a filter assembly for filtering of said processing solution.

7. A modular photographic processor according to claim 6 wherein said at least one processing component comprises a pump for pumping the processing solution through said recirculation system.

8. A modular photographic processor according to claim 1 wherein said at least one processing component comprises a replenishment system for replenishing said processing solution.

9. A modular photographic processor according to claim 1 wherein said at least one removable processing tank includes at least one electrical wire connected to another component secured to said processor, said processor further comprising a quick disconnect electrical connection to said at least one electrical wire.

10. A modular photographic processor according to claim 1 wherein said at least one component includes at least one electrical wire connected to another component secured to said processor, said processor further comprising a quick disconnect electrical connection to said at least one electrical wire.

11. A modular photographic processor according to claim 1 further comprising quick release means for securing said processing tank at said predetermined location.

12. A method of converting a processor designed to process a first type of photosensitive material requiring a first type of processing chemicals to a second type photosensitive material requiring a second different type processing chemicals, said processor having a processing tank for holding a processing solution therein, said processing tank having an outlet port and an inlet port, and a modular recirculation system having a first inlet end and a second outlet end, said second outlet end of said recirculation system being connected to said inlet port of said processing tank by a first quick disconnect dripless fluid valve assembly, and said first inlet end of said recirculation system being connected to said outlet port of said processing tank by a second quick disconnect dripless fluid valve assembly, said recirculation system including at least one fluid processing component which is connected to said recirculation system by at least one third quick disconnect dripless fluid valve assembly, the method comprising the steps of:

a) removing said at least one fluid processing component and replacing it with a second fluid processing component;

b) flushing the recirculation system and forwarding any residual therefrom to drain; and c) providing fresh processing chemicals into said processing tank.

13. A method of converting a processor designed to process a first type of photosensitive material requiring a first type of processing chemicals to a second type photosensitive material requiring a second different type of processing chemicals, said processor having a first removable processing tank for holding a first processing solution for processing of a photosensitive material therein, said first removable processing tank having an outlet port and an inlet port, and a recirculation system having a first inlet end and second outlet end, said second outlet end of said recirculation system being connected to said inlet port of said first removable processing tank by a first quick disconnect dripless fluid valve assembly, and said first inlet end of said recirculation system being connected to said outlet port of said first removable processing tank by a second quick disconnect dripless fluid valve assembly, the method comprising the steps of:

a) removing said first removable processing tank and replacing it with a second removable processing tank for containing a second processing solution different from said first processing solution;

b) flushing the recirculation system with an appropriate solution and forwarding any residual therefrom to drain; and c) providing fresh processing chemicals into said second processing tank.

14. The method according to claim 13 wherein said appropriate solution comprises said second processing solution.

15. The method according to claim 13 wherein said appropriate solution comprises a rinse solution.

16. A modular photographic processor for processing a photosensitive material comprising:

a modular processing section containing at least one removable processing tank for holding a processing solution therein, said at least removable processing tank having an outlet port and an inlet port, and a modular recirculation system having a first inlet end and a second outlet end, said second outlet end of said recirculation system being connected to said inlet port of said at least one removable processing tank by a first quick disconnect dripless fluid valve assembly, and said first inlet end of said recirculation system being connected to said outlet port of said at least one removable processing tank by a second quick disconnect dripless fluid valve assembly, wherein said processor further comprises means to prevent operation of the at least one removable processing tank until all appropriate connections have been made to the at least removable processing tank and the at least one removable processing tank is properly aligned in said processing section.

17. A modular photographic processor according to claim 16 wherein said modular recirculation system comprises at least one fluid processing component which is connected to said recirculation system by at least one third quick disconnect dripless fluid valve assembly.

18. A modular photographic processor according to claim 16 wherein each of said quick disconnect dripless fluid valve assemblies comprises a pair of mating half valve sections that can be quickly connected or disconnected.

19. A modular photographic processor according to claim 16 wherein said at least one removable processing tank comprises a low volume thin tank processor.

20. A modular photographic processor according to claim 16 wherein said at least one removable processing tank comprises a container, at least one processing assembly placed in said container and at least one transport assembly disposed adjacent said at least one processing assembly, said at least one processing assembly and said at least one transport assembly forming a substantially continuous processing channel through which a processing solution flows, said processing channel comprising at least 40% of the total volume of the processing solution available for the processing tank, the processing channel having a thickness equal to or less than about 100 times the thickness of the photosensitive material to be processed in said processing channel.

21. A modular photographic processor according to claim 17 wherein said at least one processing component comprises a filter assembly for filtering of said processing solution.

22. A modular photographic processor according to claim 17 wherein said at least one processing component comprises a pump for pumping the processing solution through said recirculation system.

23. A modular photographic processor according to claim 16 wherein said at least one removable processing tank includes at least one electrical wire connected to another component secured to said processor, said processor further comprising a quick disconnect electrical connection to said at least one electrical wire.

24. A modular photographic processor for processing a photosensitive material comprising:

a support frame having a plurality of vertically aligned mounting positions, wherein a horizontally slidable base is located at each of said mounting positions; and a plurality of removable modular processing sections mounted on a respective horizontally slidable base in said plurality of vertically aligned mounting positions.

25. A modular photographic processor according to claim 24 wherein said plurality of processing sections comprises at least removable processing tank having an outlet port and an inlet port.

26. A modular photographic processor according to claim 25 wherein said plurality of processing sections comprises a modular recirculation system having a first inlet end and a second outlet end, said second outlet end of said recirculation system being connected to said inlet port of said at least one removable processing tank by a first quick disconnect dripless fluid valve assembly, and said first inlet end of said recirculation system being connected to said outlet port of said at least one removable processing tank by a second quick disconnect dripless fluid valve assembly.

27. A method of evaluating various different set-ups in a processor designed to process photosensitive material, said processor having a modular replaceable processing tank for holding a processing solution therein, said modular replaceable processing tank having an outlet port and an inlet port, and a modular recirculation system having a first inlet end and a second outlet end, said second outlet end of said recirculation system being connected to said inlet port of said processing tank by a first quick disconnect dripless fluid valve assembly, and said first inlet end of said recirculation system being connected to said outlet port of said processing tank by a second quick disconnect dripless fluid valve assembly, said recirculation system including at least one fluid processing component which is connected to said recirculation system by at least one third quick disconnect dripless fluid valve assembly, the method comprising the steps of:

a) removing at least one fluid processing component and replacing it with a second fluid processing component; and b) evaluating the processor or said removed processing component.

* * * * *